US005594529A

United States Patent [19]

Yamashita et al.

[11] Patent Number: 5,594,529

[45] Date of Patent: Jan. 14, 1997

[54] IMAGING DEVICE WITH STOCK SUPERVISION MEANS

[75] Inventors: Yuji Yamashita; Jiro Nagira; Yasuhiro Hashimoto; Fumio Aizawa, all of Osaka, Japan

[73] Assignee: Exedy Corporation, Osaka, Japan

[21] Appl. No.: 563,249

[22] Filed: Nov. 27, 1995

[30] Foreign Application Priority Data

| | | | |
|---|---|---|---|
| Nov. 30, 1994 | [JP] | Japan | 6-297674 |
| Nov. 30, 1994 | [JP] | Japan | 6-297676 |
| Nov. 30, 1994 | [JP] | Japan | 6-297677 |
| Nov. 30, 1994 | [JP] | Japan | 6-297680 |

[51] Int. Cl.[6] ..... G03G 15/00

[52] U.S. Cl. ..... 399/8; 399/24; 399/81

[58] Field of Search ..... 355/200–208

[56] References Cited

U.S. PATENT DOCUMENTS

| | | | |
|---|---|---|---|
| 4,583,834 | 4/1986 | Seko et al. | 355/206 |
| 5,057,866 | 10/1991 | Hill, Jr. et al. | 355/205 |
| 5,077,582 | 12/1991 | Kravette et al. | 355/206 |
| 5,282,127 | 1/1994 | Mii | 355/206 X |
| 5,305,199 | 4/1994 | LoBiondo et al. | 355/204 X |
| 5,335,048 | 8/1994 | Takano et al. | 355/204 |
| 5,369,471 | 11/1994 | Yamada | 355/208 |

FOREIGN PATENT DOCUMENTS

| | | |
|---|---|---|
| 0342910A2 | 11/1989 | European Pat. Off. . |
| 0685768A1 | 12/1995 | European Pat. Off. . |

*Primary Examiner*—Arthur T. Grimley
*Assistant Examiner*—Sophia S. Chen
*Attorney, Agent, or Firm*—Shinjyu Office of Patent Attorneys

[57] ABSTRACT

An imaging device supervision system stores data indicating, for instance, the number of sheets of paper supplied from each paper supply cassette in a copying machine, and/or the number of times the toner has been replenished, and the amount of toner cartridges in stock are stored in a copying machine supervision data base which is constructed, stored and maintained in a storage device, such as a hard drive. The supervision system updates the stock amounts for each size of paper based on the data indicating the number of sheets of paper supplied, and formulates a consumable item delivery plan according to delivery conditions set in a delivery schedule setting screen 91, to reduce the downtime due to stocks of consumable items being exhausted in an imaging device. Further, the amount of toner cartridges in stock are updated by means of the number of times the toner has been replenished, and the stock data are displayed on a status information screen 66.

25 Claims, 16 Drawing Sheets

S11
SET MIN. THRESHOLD VALUES
S12
DATA RECEIVED FROM COPIER?
YES
NO
S13
UPDATE COUNT & STOCK DATA
S14
STOCK> THRESHOLD ?
YES
NO
S15
TONER EMPTY?
YES
NO
S16
UPDATE TONER DATA
S17
STOCK> THRESHOLD ?
YES
NO
S18
TIME FOR COMMUNICATION ?
YES
NO
S19
CONNECT TO HOST COMPUTER
S20
SEND DATA
S21
DATA RESET ?
NO
YES
S22
COUNT RESET
S23
END COMMUNICATION (WITH HOST COMPUTER)
S24
OTHER OPERATIONS

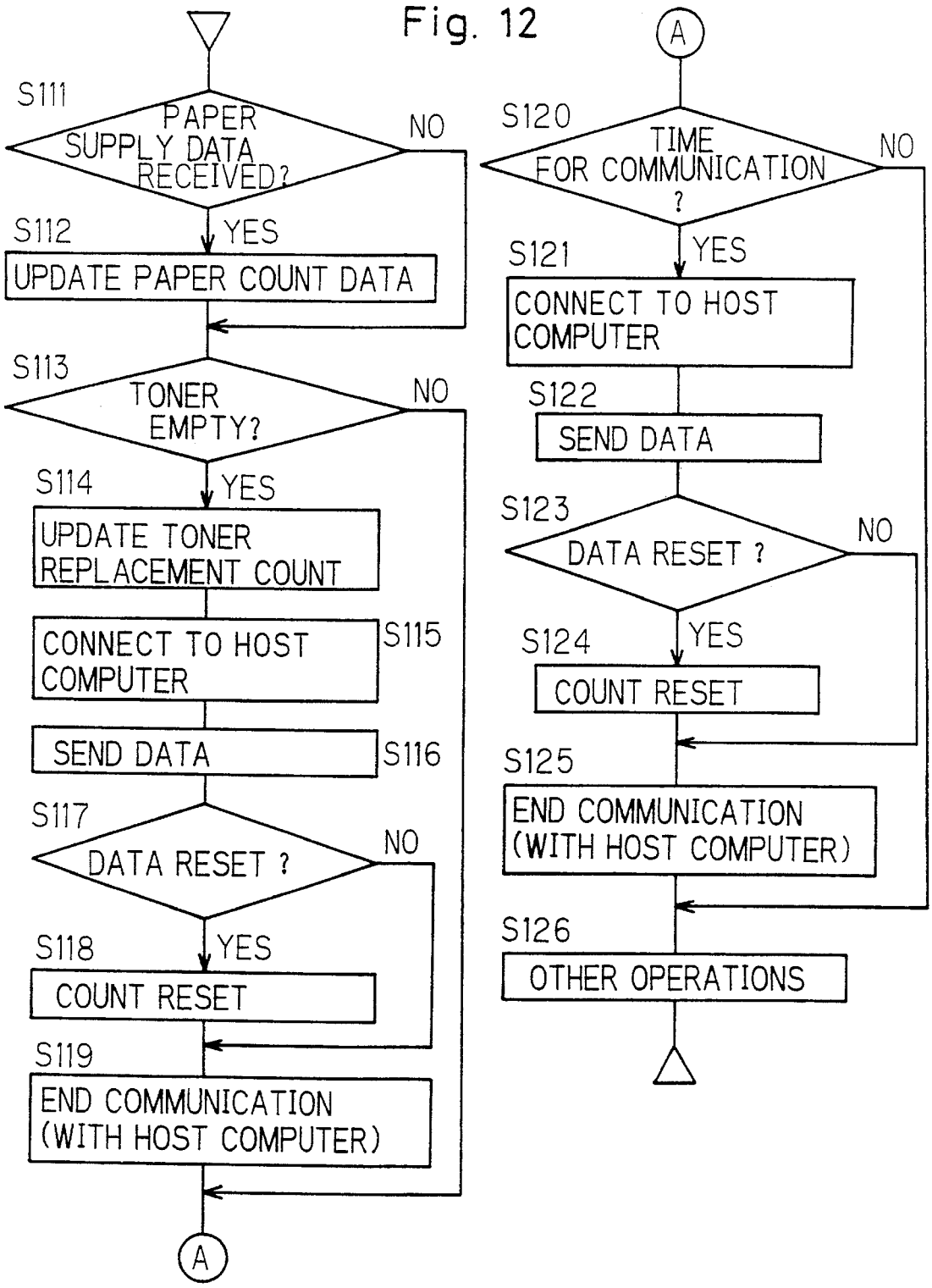
Fig. 12
S111
PAPER SUPPLY DATA RECEIVED?
NO
YES
S112
UPDATE PAPER COUNT DATA
S113
TONER EMPTY?
NO
YES
S114
UPDATE TONER REPLACEMENT COUNT
CONNECT TO HOST COMPUTER
S115
SEND DATA
S116
S117
DATA RESET ?
NO
YES
S118
COUNT RESET
S119
END COMMUNICATION (WITH HOST COMPUTER)
A
A
S120
TIME FOR COMMUNICATION ?
NO
YES
S121
CONNECT TO HOST COMPUTER
S122
SEND DATA
S123
DATA RESET ?
NO
YES
S124
COUNT RESET
S125
END COMMUNICATION (WITH HOST COMPUTER)
S126
OTHER OPERATIONS S231
COMMUNICATION MADE?
NO
YES
S232
RECEIVE DATA
S233
UPDATE STOCK DATA & USE DATA
S234
CALCULATE AVERAGE USE
S235
ESTIMATE OUT OF STOCK TIME
CALCULATE MIN. STOCK & APPROPRIATE STOCK
S236
S237
DISPLAY STOCK DATA
S238
RESET ?
YES
S239
SEND RESET COMMAND
NO
S240
END COMMUNICATION(WITH SUPERVISION DEVICE)
S241
FORMULATE DELIVERY PLAN
S242
COMMAND DELIVERY
S243
OTHER OPERATIONS

IMAGING DEVICE WITH STOCK SUPERVISION MEANS

BACKGROUND OF THE INVENTION

A. Field of the Invention

The present invention relates to imaging devices and imaging device supervision systems, and in particular relates to imaging device supervision systems which remotely supervise the amount of stock of consumable items in the imaging device.

B. Description of the Related Art

Many imaging devices, such as photocopying machines, have on their upper surface a display means, such as a liquid crystal panel or LEDs. If a consumable item such as paper or toner, is exhausted, this fact is detected by the imaging device and displayed on the abovementioned display means, prompting the user to replenish the item. The user would then put more paper in the photocopier or might put a new toner cartridge in the photocopier to replenish supplies in response to the instructions on the display means.

Typically at large offices and business where numerous photocopies are made on a regular basis, a large supply of paper and several extra toner cartridges are kept in stock in proximity to the photocopier. The photocopier user must regularly conduct an inventory to be sure plenty of supplies are on hand. When the supplies run low, an order must be placed to replenish depleted stocks. Usually, there is a delay or lag time between the time the order for supplies is placed and the actual delivery date of the supplies. Occasionally, however, the user may forget to conduct an inventory, and may run out of either paper or toner. A hastily placed order may then result in a special delivery of supplies that may cost the user an extra fee.

Photocopier machines typically include a cleaner for wiping excess toner off of the imaging drum. The cleaner collects the toner. After extended use of the photocopier, the collected toner overflows and the display panel displays a message indicating that the cleaner needs to be serviced due to toner overflow. The cleaner is a dirty, dusty component within the photocopier and is usually not serviced by the user, but is serviced by maintenance personnel. The user must contact a local service center to have the photocopier serviced before further usage, in response to a toner overflow indicated on the display means. Thus there is a lag time until the toner cleaner is emptied. The time spent waiting for servicing or for supplies to be delivered when supplies have been exhausted is referred to as downtime.

It is known to have photocopying machine supervision systems in which the photocopiers communicate with a host computer via communication lines. In such systems, the host computer may receive information such as whether or not the toner is low, or that the copying machine is out of paper.

With the abovementioned copying machine supervision system, each connected copying machine communicates with the host computer periodically, and sends operational data. In such a copying machine supervision system, only the information displayed on the display means is transmitted to the host computer. Thus there is no supervision of the supplies of consumable items, such as paper and toner, stocked by the user. Hence, such known supervision systems do not assist in significantly reducing the abovementioned downtime.

SUMMARY OF THE INVENTION

One objective of the present invention is to attempt to reduce the downtime due to exhaustion of supplies of paper and toner proximate imaging devices.

Another object of the present invention is to provide an imaging device supervision system which assists in minimizing the storage space necessary for supplies of paper and toner proximate an imaging device by closely monitoring the quantity of supplies electronically.

In one aspect of the invention, an imaging device has associated therewith, a supply of consumable items. A stock supervision device is electronically connected to the imaging device. The stock supervision device is configured to electronically store stock data relating to the supply of consumable items. The stock supervision device is also configured to update the stock data based on use data transmitted from the imaging device to the stock supervision device. A stock estimating device is connected to the stock supervision device. The stock estimating device is configured to estimate a time interval in which the supply of consumable items of the imaging device might become exhausted in response to communications with the stock supervision device.

Preferably, the stock supervision device is connected to at least one sensor within the imaging device which monitors paper usage within the imaging device.

Preferably, the imaging device is a photocopying machine and the stock supervision device is connected to at least one sensor within the photocopying machine which monitors for a toner empty condition.

Still more preferably the imaging device is a photocopying machine and the stock supervision device is connected to a controller within the imaging device.

It is preferable that the stock estimating device is a host computer having electronic communication means, such as a modem, for connecting with a plurality of the supervision devices.

Preferably, the host computer calculates average use data for the imaging device, based on the use data, and estimates the time at which stocks of the consumable items will be exhausted, based on the stock data and the average use data.

Preferably, the supervision device communicates at predetermined time intervals with the host computer.

Preferably, the supervision device transmits to the host computer a paper supply count for each size of paper in the imaging device.

Preferably, the supervision device initiates communications with the host computer in response to a predetermined variation in the use data.

It is possible for the supervision device to communicate with the host computer in response to a toner-empty signal from the imaging device.

Preferably, the host computer is configured to calculate a delivery stock order of consumable items to add to the supply of consumable items in response to data transmitted from the supervision device to the host computer.

In another aspect of the invention, an imaging device supervision system includes an imaging device and a supervision device in electronic communication with the imaging device. The supervision device is configured to electronically store stock data and use data, the supervision device updating the stock data in response to the use data being transmitted from the imaging device. A host computer is in electronic communication with the supervision device, wherein the supervision device is configured to compare the use data with the stock data and communicate with the host computer in response to the comparison between the use data and the stock data and to transmit the use data to the host computer.

Preferably, the stock data includes a threshold value representing a minimum amount of stock calculated based on previous use data.

Preferably, the host computer calculates average use data based upon the use data, calculates an estimated amount of consumable items used between a current date and an expected delivery date based upon the average use data, and calculates a required minimum amount of stock based on a time lag between the expected delivery date and the real delivery date, and calculates an appropriate amount of stock based on the minimum amount of stock and the estimated amount of consumable items used.

Preferably, the host computer includes a display means which displays the stock data.

In yet another aspect of the present invention, a method for monitoring supplies of consumable items used by an imaging device includes the steps of:

providing an imaging device with means for sensing paper usage and toner usage and a supply of paper proximate the imaging device;

transmitting use data indicating paper usage to a supervision device from the imaging device;

transmitting use data from the supervision device to a host computer, the host computer maintaining a database having information about the supply of paper proximate the imaging device;

calculating the amount of paper remaining proximate the imaging device in response to the host computer receiving transmitted use data from the supervision device;

determining whether more paper is needed proximate the imaging device;

calculating the amount of supplies needed to maintain a continuous supply of paper and toner proximate the imaging device to avoid downtime.

Preferably the above method includes the step of displaying the use data and the calculated information on a display monitor.

In still another aspect of the present invention, a method for monitoring supplies of consumable items used by an imaging device includes the steps of:

providing an imaging device with means for sensing paper usage and toner usage and a supply of paper and toner proximate the imaging device;

transmitting use data indicating paper usage and toner usage to a supervision device from the imaging device;

transmitting use data from the supervision device to a host computer, the host computer maintaining a database having information about the supply of paper and toner proximate the imaging device;

calculating the amount of supplies remaining proximate the imaging device in response to the host computer receiving transmitted use data from the supervision device;

determining whether more supplies are needed proximate the imaging device;

calculating the amount of supplies needed to maintain a continuous supply of paper and toner proximate the imaging device to avoid downtime.

Preferably, the above method includes the step of displaying the use data and the calculated information on a display monitor.

In the above supervision method and system, the imaging device and supervision device communicate with a host computer via a line, and send consumable item use data to the host computer. As a result, it is therefore possible for the host computer to perform stock supervision based on the use data for each imaging device, and it is also possible to formulate a delivery plan by estimating the time at which stocks will be exhausted.

With a construction in which an host computer calculates average use data based on the use data for each imaging device, and estimates therefrom the time at which stocks will be exhausted, it is possible for the host computer to estimate the time at which stocks of consumable items in each imaging device will be exhausted, based on the use data which are sent via the line. It is therefore also possible to formulate accurately an item delivery plan.

With a construction in which the supervision device communicates regularly with the host computer, consumable item use data for each imaging device are sent to the host computer together with other operating data during the regular communications. The host computer updates the stock data being supervised by the stock supervision unit, based on the use data which are sent during regular communications, and can thus estimate the time at which stocks of consumable items will be exhausted.

With a construction in which the supervision device sends paper supply count numbers for each size in the imaging device to the host computer, it is possible for the supervision unit to supervise stocks of paper for each size in each imaging device.

With a construction in which the supervision device communicates with the host computer when there is a variation in the consumable item use data, it is possible for stock data which are being supervised by the host computer to be successively updated, in accordance with the use conditions for each imaging device, and it is therefore possible to perform real time estimation of the time at which stocks will be exhausted. For example, with a construction in which communications with the host computer are performed based on a toner-empty signal, it is possible to supervise the toner use data based on the toner-empty signal, and it is thus possible for the host computer to perform stock supervision of toner cartridges in each imaging device.

With a construction in which the host computer is furthermore provided with a delivery command unit which formulates a consumable item delivery plan based on the estimated time at which stocks will be exhausted, estimated by the host computer, it is possible to reduce greatly the downtime resulting from stocks held by the user becoming exhausted, by issuing a command to a dispatch center or the like before stocks are exhausted for each imaging device.

In the imaging device according to the present invention, the stock data supervision unit stores consumable item stock data and use data, and updates the stock data based on the use data. The supervision unit compares the stock data with a prescribed threshold, and communication with the host computer can be initiated based on the results of the comparison and whereupon the supervision unit transmits the current stock data and use data to the host computer. Therefore the host computer need not perform particular consumable item stock supervision for the imaging devices, and can formulate a consumable item delivery plan based on the communication from the imaging devices.

When a minimum amount of stock, calculated based on the consumable item stock data and the use data, is used as the threshold in the supervision device, stock supervision by the user can be kept to a minimum.

Further, with the imaging device supervision system according to the present invention, a plurality of imaging devices are connected to a host computer via lines, and if the consumable item stock data for each imaging device drops below a prescribed threshold, communication is established with the host computer and the stock data and use data are transmitted. There is thus no need for the host computer to perform continuous consumable item stock supervision for each imaging device. In a system in which the host computer estimates the time at which consumable items will be exhausted in each device, it is possible to perform accurate stock supervision by means of communications, even if the amount of consumable items used by the imaging device exceeds the estimated amount, and it is therefore possible to reduce the downtime.

If the host computer is constructed such that it calculates the minimum amount of stock based on the consumable item stock data and use data, and sets the threshold in the out-of-stock detection unit to the minimum amount of stock, it is possible to perform accurate stock supervision based on the most up-to-date use data.

Further, the host computer has a construction in which there is provided a display having delivery display instructions which include amounts of consumable items that should be delivered based on the stock data and the use data for the imaging devices.

With the imaging device supervision system according to the present invention, the stock data which are being supervised by the host computer are successively updated based on the consumable item use data for the imaging device. The time at which stocks of the consumable item will be exhausted, estimated based on the consumable item stock data and use data, or the order date on which the consumable item was ordered is supervised as the expected delivery date. The host computer calculates an appropriate amount of stock of the consumable item, based on the consumable item stock data and use data and the expected delivery date, and supervises stocks of consumable items for each copying device based on this information.

With a construction in which the appropriate stock amount is determined, the host computer calculates average use data from the consumable item use data, and calculates a required minimum amount of stock based on the estimated amount used between delivery dates, which is based on the average use data, and the time lag between the expected delivery date and the real delivery date. Thus it is possible to calculate accurate appropriate amounts of stock based on the most up-to-date consumable item use data. Furthermore it is possible to reduce the downtime between the expected delivery data and the real delivery date resulting from stock being exhausted.

These and other objects, features, aspects and advantages of the present invention will become more fully apparent from the following detailed description of the present invention when taken in conjunction with the accompanying drawings where like reference numerals denote corresponding parts throughout, in which:

BRIEF DESCRIPTION OF THE DRAWINGS

FIG. 12 is a flowchart showing the operation of the photocopier machine supervision device depicted in FIGS. 1 and 4, in accordance with a second embodiment of the present invention;

DETAILED DESCRIPTION OF THE PREFERRED EMBODIMENTS

Figure 1:
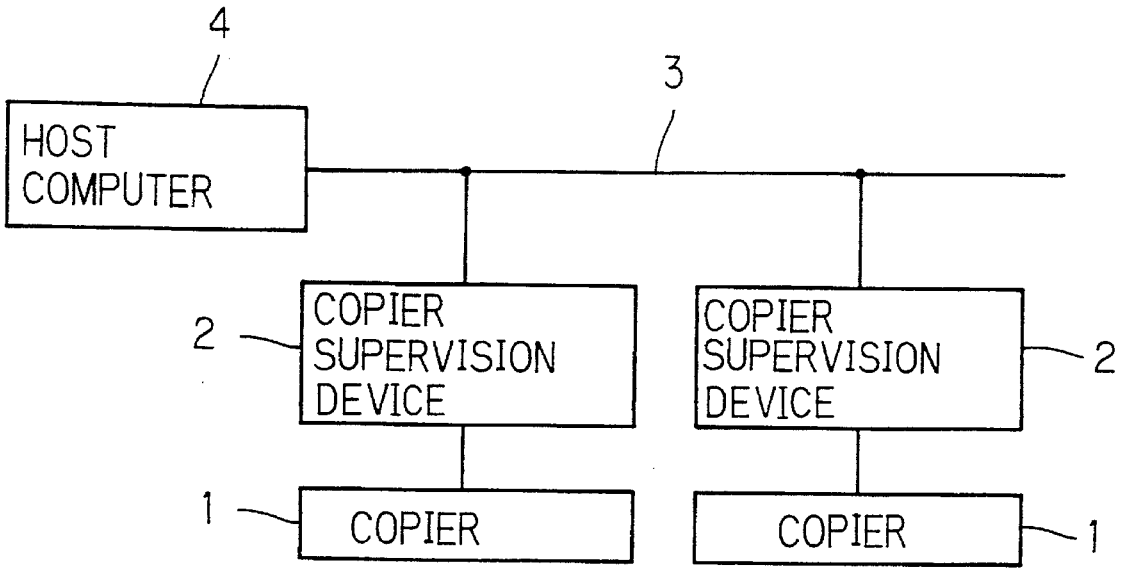
FIG. 1 is a schematic of an imaging device supervision system including several photocopier machines each connected to a copier supervision device and each copier supervision device is connected to a single monitoring host computer in accordance with the present invention.

FIG. 1 shows schematically an imaging device supervision system in accordance with each of the embodiments of the present invention described below. Here, the imaging device is a copying machine, but it should be understood that similar devices may be applied to the present invention, such as facsimile machines or the like. As is shown in FIG. 1, each of a plurality of copying machines 1 is connected for electronic communication with a copying machine supervision device 2. Each copying machine supervision device 2 is connected to a host computer 4 via a communication line 3. Although only two copying machines 1 are shown in FIG. 1, several hundred copying machines 1 and corresponding copying machine supervision devices 2 could be associated with a single host computer 4. It should also be appreciated that the communication line 3 may be a public telephone line, a network link or other similar electronic communication line or link.

Figure 2:
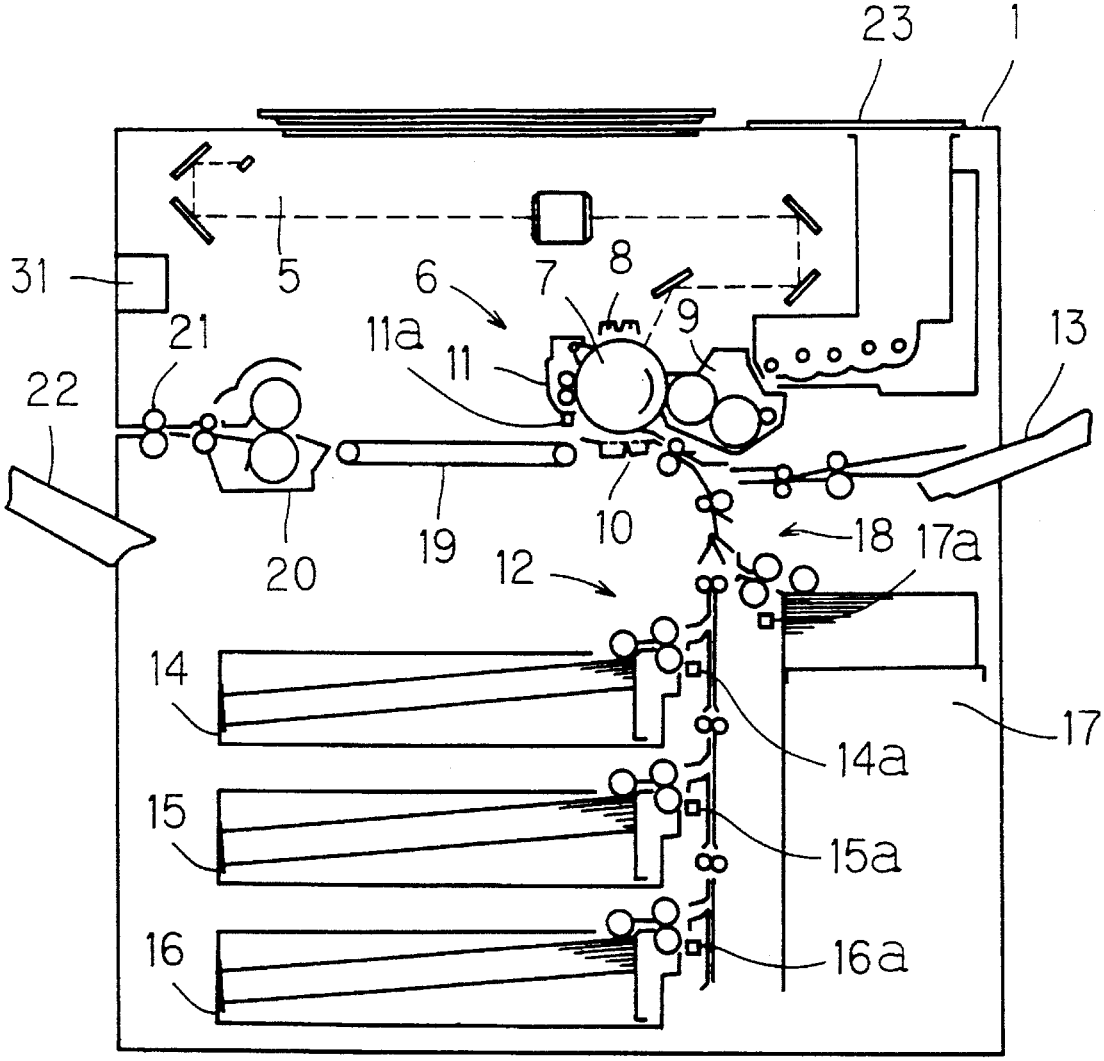
FIG. 2 is a schematic side view of one of the photocopier machines depicted in FIG. 1.

As shown in FIG. 2, the copying machine 1 is provided at the top with an exposure unit 5 for reading documents. The exposure unit 5 includes a light source, mirrors and a lens unit, inter alia. Further, an imaging unit 6 for forming on paper a toner image of the document which has been read by the exposure unit 5, is provided at the center of the copying machine 1. The imaging unit 6 has a photosensitive drum 7 on the surface of which an electrostatic latent image is formed. A charging device 8, a developer device 9, a transfer device 10 and a cleaning device 11 are arranged around the photosensitive drum 7. A toner overflow sensor 11*a* is provided with the cleaning device 11.

A paper supply unit 12 is provided at the bottom of the copying machine 1. The paper supply unit 12 includes a bypass table 13 which is provided to the right of the copying machine 1 in FIG. 2, three paper supply cassettes 14, 15 and 16 which are arranged vertically at the bottom of the copying machine 1, a large-volume paper supply device 17 and a paper transport device 18 for conveying paper stored in the bypass table 13 or the paper supply cassettes 14 to 17 to the imaging unit 6. Sensors 14*a*, 15*a*, 16*a* and 17*a* are provided at each respective paper supply end of each paper supply cassette 14, 15, 16 and 17, respectively, and it is possible to detect the number of sheets of paper conveyed from each paper supply cassette by means of the sensors 14*a*, 15*a*, 16*a* and 17*a*.

A paper discharge transport path 19 for transporting paper to the left of the device in FIG. 2, a fusing device 20 which fuses the toner image on the paper, discharge rollers 21 for discharging the paper during fusing, and a paper discharge tray 22 which receives the paper are provided on the downstream side of the imaging unit 6 in the paper transport direction.

Figure 3:
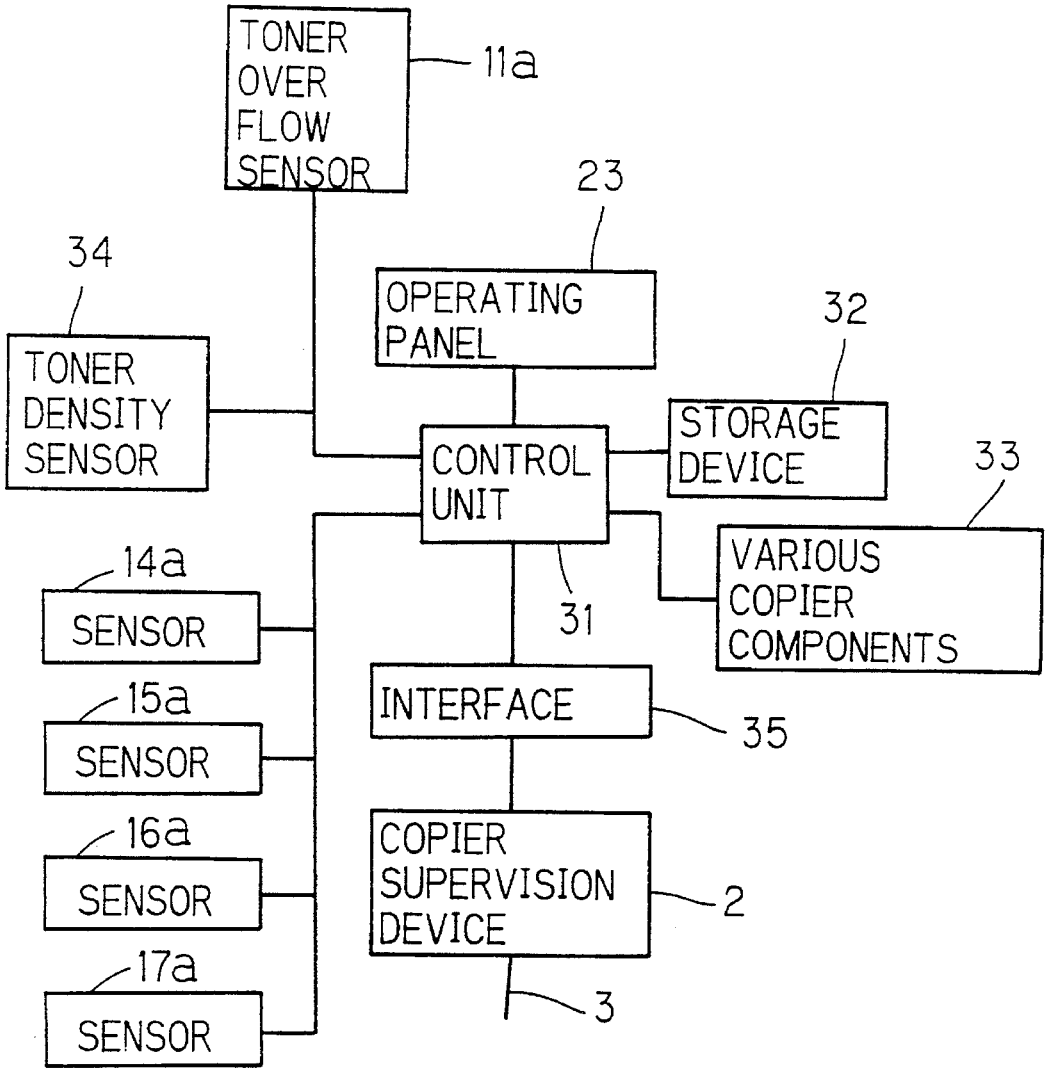
FIG. 3 is a block diagram showing a control unit and associated components of the photocopier machine depicted in FIG. 2.

The copying machine 1 also includes a control unit 31, as shown in FIG. 2. The control unit 31 includes of a microcomputer including a CPU, RAM, ROM, various drivers and various I/Os (not shown). As shown in FIG. 3, input keys and a display unit on an operating panel 23 are connected to the control unit 31. Further, a storage unit 32, which stores various items of operating data, is connected to the control unit 31. The various sensors 14*a*, 15*a*, 16*a* and 17*a*, are all connected to the control unit 31 and relay information concerning the number of sheets of paper supplied from each paper supply cassette 14, 15, 16 and 17, respectively. Furthermore, a toner density detection sensor 34, which detects the density of toner within the developer unit 9, is connected to the control unit 31. The toner density detection sensor 34 is provided in the developer device 9 in order to detect the density of toner supplied from a toner cartridge into the developer device 9. An interface 35, which is connected to the control unit 31, is also connected to a copying machine supervision device 2. Toner-empty signals, and data indicating the number of sheets of paper supplied from each paper cassette are sent to the copying machine supervision device 2 via the interface 35. The toner overflow sensor 11*a* is further connected to the control unit 31. Various copier components 33 are also connected to control unit 31.

Figure 4:
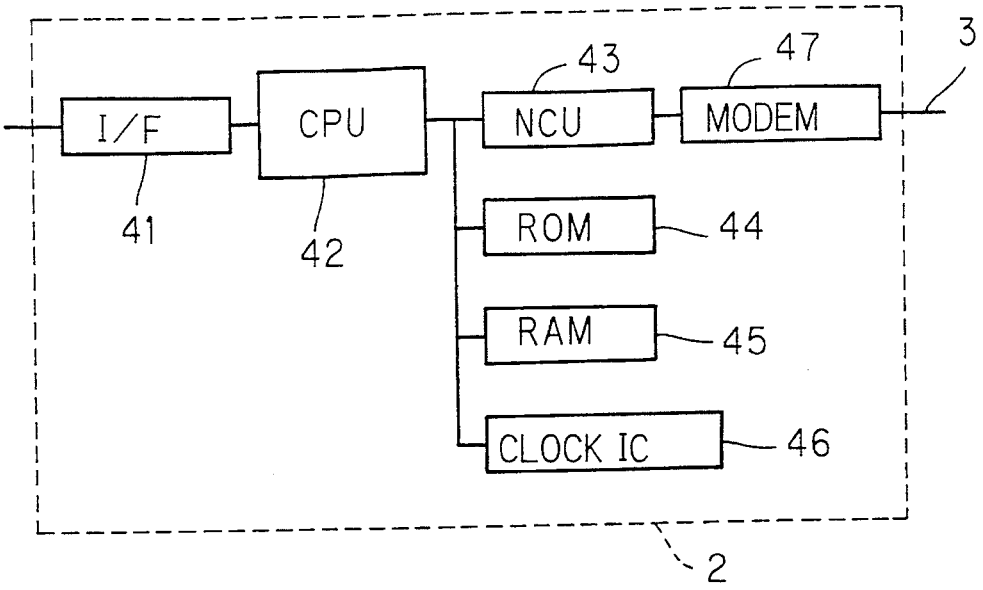
FIG. 4 is a block diagram showing various components of one of the photocopier machine supervision devices depicted in FIG. 1.

As shown in FIG. 4, the copying machine supervision device 2 has a serial interface 41 which is connected to the interface 35 of the copying machine 1. The serial interface 41 is connected to a CPU 42. The CPU 42 may be a microcomputer system with associated memory, storage devices and I/O bus or merely a small microprocessor controller, depending upon the configuration of the device 2 and the needs of the overall application of the system. The CPU 42 is connected to a network control unit 43 (referred to as an NCU 43 hereinbelow), ROM 44, RAM 45 and a clock IC 46. The NCU 43 is connected to a modem 47, and the modem 47 may connected to a telephone line or a network, depending upon the configuration of the host computer 4. For instance, if the host computer 4 is at a remote location, then a telephone line may connect the host computer 4 with the supervision system 2. Alternatively, if the host computer is nearby, for instance, in the same building as the copiers 1, then a serial line communication, network or the like may be used to connect the host computer 4 with the supervision system 2.

Figure 5:
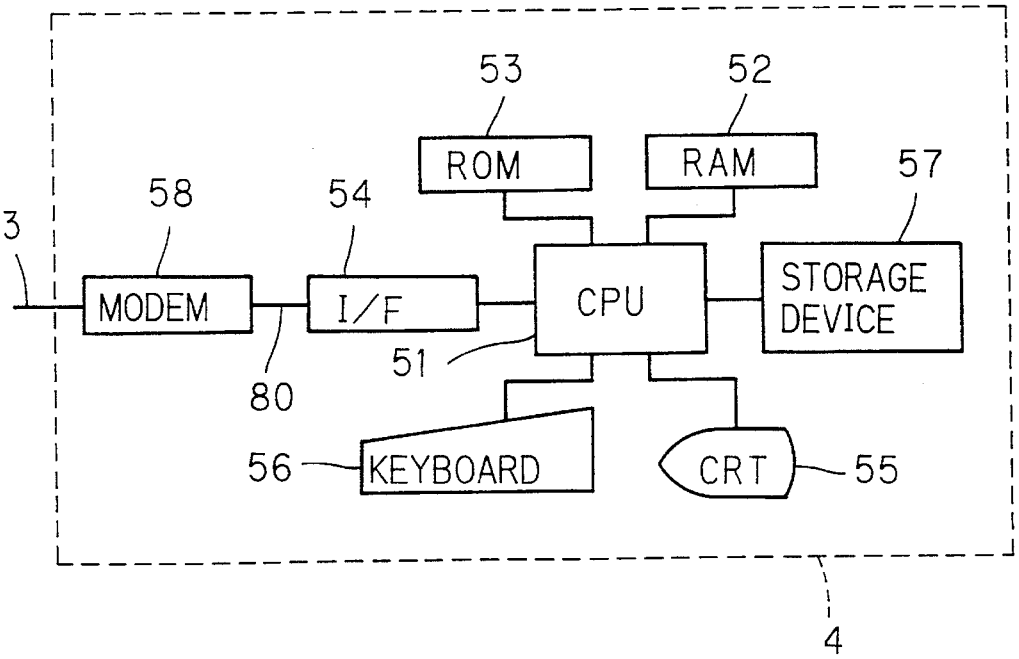
FIG. 5 is a block diagram showing various components of the host computer depicted in FIG. 1.

As shown in FIG. 5, the host computer 4 includes a CPU 51, RAM 52 and ROM 53 which are connected to the CPU 51 and an input/output interface 54. A display CRT 55, an input keyboard 56 and a storage device 57, for example, are also connected to the CPU 51. The storage device 57 is, for example, a hard disk drive (HDD) that stores data. The input/output interface 54 is provided with an RS232C input/output terminal 80, or the like, and is connected to the telephone line 3 via a communications modem 58 (or a serial line if the host computer 4 and the copier 1 are proximate one another). A copying machine supervision data base, for supervising the operating data for each copying machine 1 is maintained by the host computer 4 and stored in the storage device 57, as will be discussed in greater detail below.

The operation of the present invention will now be described based on the flowcharts shown in the figures.

Figure 6:
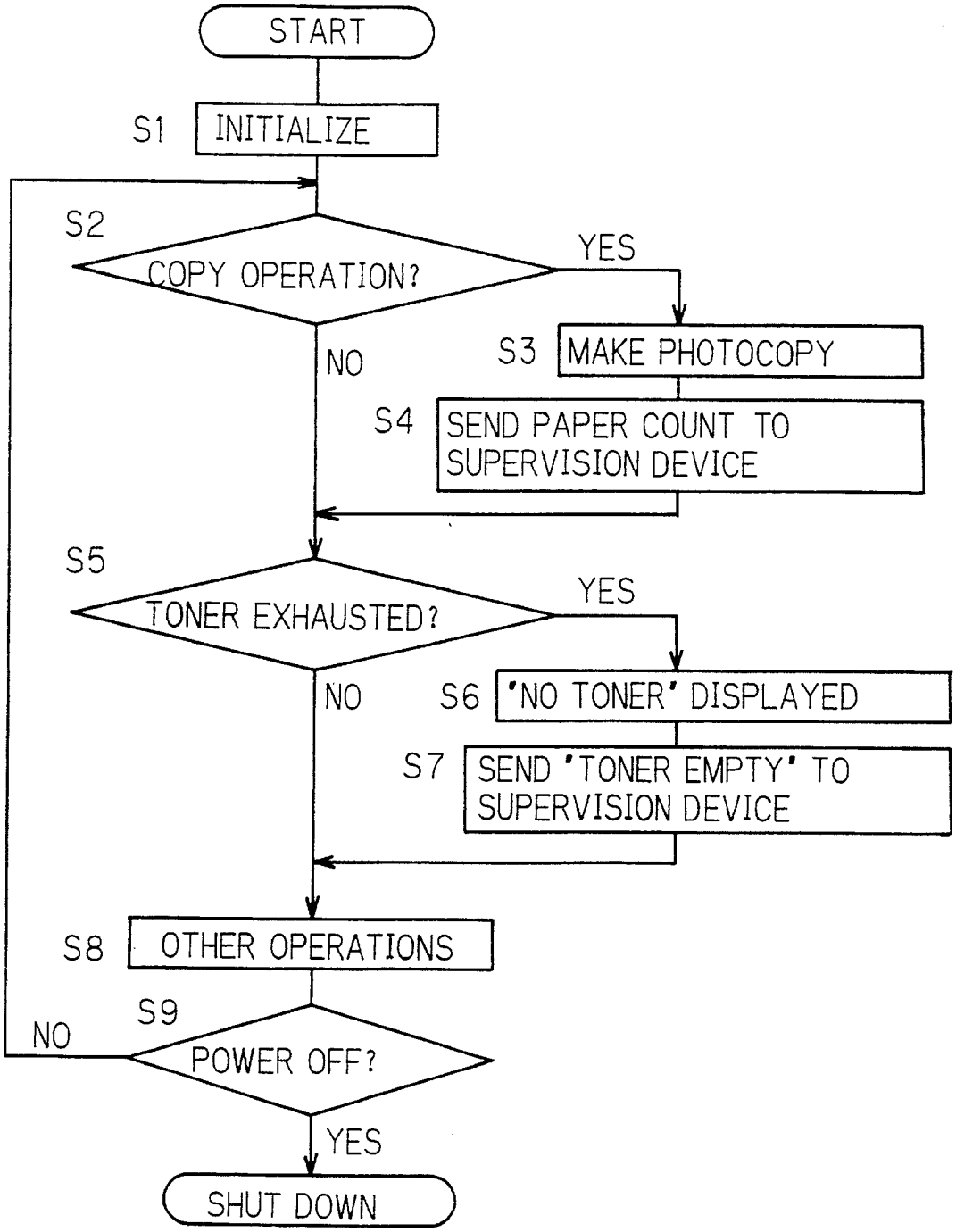
FIG. 6 is a flowchart showing the general operation of the photocopier machine depicted in FIG. 2.

The copying machine 1 operates as shown in FIG. 6. When the power supply is switched on, various parameters are initialized in step S1, and commands are issued to set the temperature of the fusing device 20. In step S2 a judgment is made to determine whether or not an input key on the operating panel 23 has been pressed to initiate the photocopying process. If it is determined that the input key on the operating panel 23 has been pressed, then the process moves to step S3. In step S3, the normal copy action is performed based on the operation of the input key unit on the operating panel 23. In step S4, data indicating the number of sheets of paper supplied from each paper supply cassette based on the copy action in step S3 are sent to the copying machine supervision device 2. The usage of paper is monitored in the present invention. It should be understood that the usage of paper may be monitored by the sensors 14*a*, 15*a*, 16*a* or 17*a*, or may alternatively be monitored by the control unit 31. For instance, it is well known for photocopier machines to automatically detect the size of the paper being copied and automatically feed the proper sized paper for producing an image on the paper. Further it is also possible on most photocopier machines for the user to select a paper size, and the control unit feeds the chosen paper for forming an image thereon. In either instance, the control unit 31 may be configured to send a signal to the copying machine supervision device 2 based upon paper usage, or sensors 14*a*, 15*a*, 16*a* and 17*a* may be configured to send a paper usage signal to the copying machine supervision device 2.

In step S5 a judgment is made to determine whether or not the toner within the developer device 9 has been exhausted. The no-toner detection may, for example, be performed by determining whether or not the toner density detected by the toner density detection sensor 34 which is provided with the toner device 9 is below a predetermined value. If it is detected that the toner has been exhausted then the process moves to step S6. In step S6, the display unit such as a liquid crystal display device or an LED, provided on the operating panel 23, indicates that the toner has been exhausted. In step S7 a toner-empty signal is sent to the copying machine supervision device 2. Other processes are performed in step S8. In step S9 a judgment is made to determine whether or not the power supply switch has been operated, and if the power supply is on then the process moves to step S2 and if the power supply has been switched off then the copying machine 1 shuts down.

FIRST EMBODIMENT

The copying machine supervision device 2 is configured to store and maintain at least three distinct types of data: 1) use data; 2) stock data; and 3) supervision data. The use data is received from a corresponding photocopying machine 1. The supervision device 2 subsequently transmits the use data to the host computer 4, as is described in greater detail below. The use data received from the photocopying machine includes a count of paper usage by the photocopying machine 1, and toner usage. For instance, the use data received by the device 2 includes a count of each page of paper used by the photocopying machine 1, categorized by the size of the paper used. With regard to toner usage, the data received by the device 2 includes a count of each time the toner density in the developer device 9 is low (indicating an out of toner condition), and a count of each time the toner overflows in the cleaning device 11.

The stock data and supervision data are stored in the RAM 45 of the supervision device 2, but are transmitted from the host computer 4 to the supervision device 2, as will be explained in greater detail below. The stock data relates to the supply of consumable stock items, such as cases of paper and replacement toner cartridges for the photocopying machine 1. Specifically, the stock data relates to supplies that are maintained on site either beside or near the photocopying device 1 so that when the supply of paper or toner in photocopying machine 1 is exhausted, the user may replenish the supply. The stock data represents the actual amount of the supplies of each type of paper and number of toner cartridges on site with or near the photocopying machine 1.

The supervision data includes information relating to desired quantities of supplies (toner and paper) that are to be maintained on site with the photocopying machine 1, based on the actual quantities of supplies on site with the photocopying machine 1 and other determined parameters, as will be explained in greater detail below.

The use data includes at least the following:

1) count of sheets of paper used (each paper size)
2) count of toner empty signals
3) count of toner overflow condition The stock data includes at least the following:

1) amount of paper located on site by paper size
2) number of toner cartridges on site The supervision data includes information on the minimum amount of stock to be maintained on site with the photocopying machine 1, as follows:

1) desired minimum amount of paper on site (by size)
2) desired minimum number of toner cartridges on site
3) toner replenishment count The supervision data is hereinafter also referred to as minimum stock data.

Figure 7:
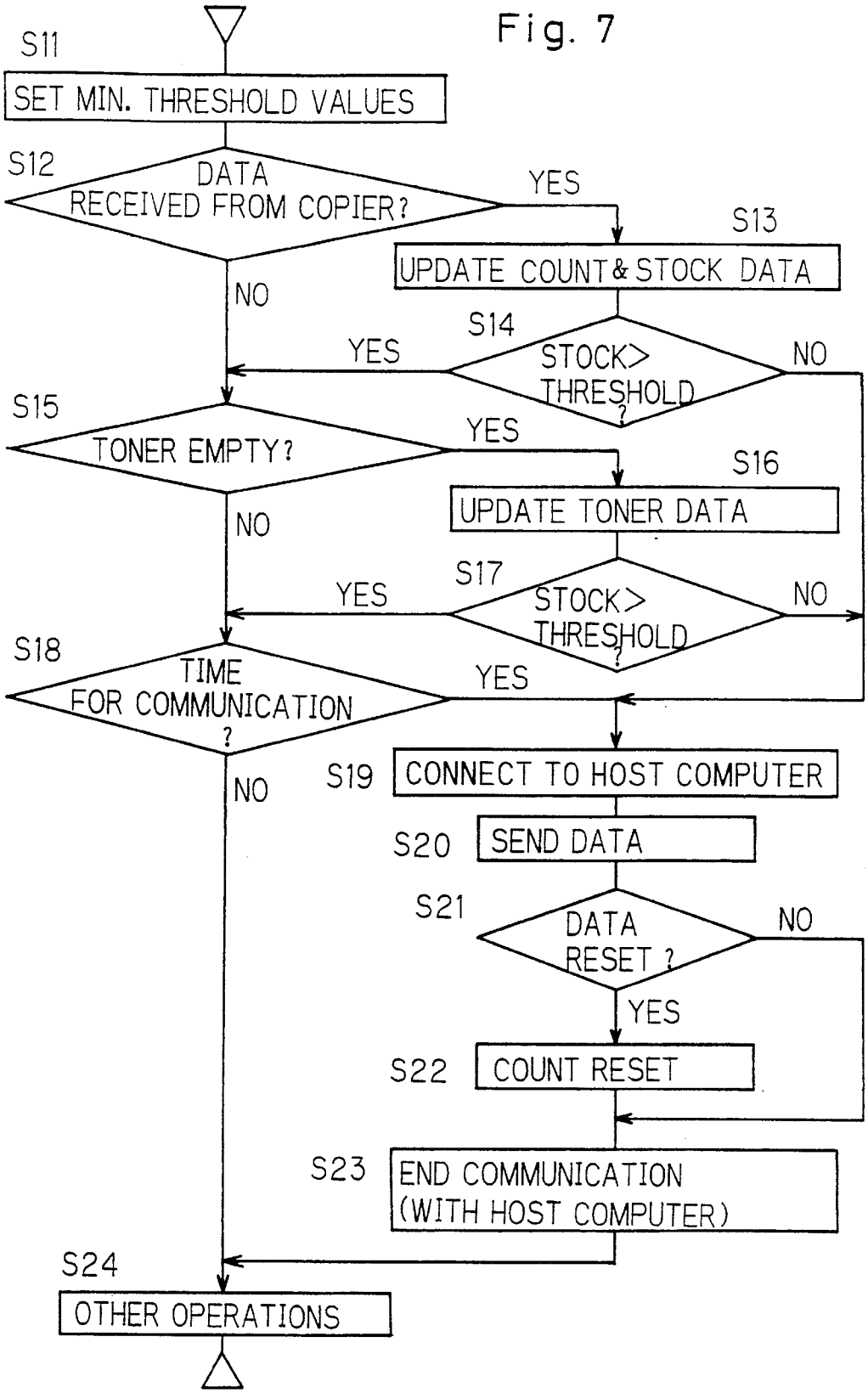
FIG. 7 is a flowchart showing the operation of the photocopier machine supervision device depicted in FIGS. 1 and 4, in accordance with a first embodiment of the present invention.

The general operation of the copying machine supervision device 2, in accordance with a first embodiment of the present invention, is shown in the flowchart FIG. 7.

As represented by the step S11, the copying machine supervision device 2 is configured to monitor for a predetermined minimum amount of stock (supervision data) on site with the photocopying machine 1, as a threshold for detecting an out-of-stock state. For instance, at step S11, the CPU 42 is initialized to enable the copying machine supervision device 2 to detect when a consumable item stock falls below a certain amount. The minimum amount of stock is calculated by the host computer 4, as is described in greater detail below. The minimum amount of stock or supervision data is transmitted to the copying machine supervision device 2 from the host computer 4 and stored in the RAM 45 of the copying machine supervision device 2.

In step S12, a judgment is made to determine whether or not use data has been received from the copying machine 1 by the copying machine supervision device 2. If the use data supplied has been received, then the process moves to step S13. In step S13, use data indicating the number of sheets used by each paper supply cassette, and supervision data, specifically paper stock data for each size, stored in the RAM 45, are updated by the CPU 42 based upon the data received from the copier 1.

In step S14, the stock data updated in step S13 are compared with the values of the minimum amount of stock stored previously in the RAM 45 in step S11. If the paper stock data for any one of the paper sizes is less than the minimum amount of stock for the corresponding paper size then the process moves to step S19. If the paper stock data is more than the minimum amount of stock for the corresponding paper size then the process moves to step S15.

In step S15, a judgment is made to determine whether or not a toner empty signal has been received from the copying machine 1. If a toner empty signal has been received from the copying machine 1 then the process moves to step S16. In step S16, a toner replenishment count stored in the RAM 45 is incremented upward, and corresponding toner cartridge stock data is also updated. In step S17, the toner cartridge stock data updated in step S16 are compared with the threshold value of the minimum amount of stock for the toner cartridges, set in step S11. If, in step S17, it is determined that the stock data for the toner cartridges is less than the minimum amount of stock then the process moves to step S19. If, in step S17, it is determined that the stock data for the toner cartridges is greater than the threshold value corresponding to the minimum amount of stock then the process moves to step S18.

In step S18, a judgment is made to determine whether or not the current time, obtained from the clock IC 46, indicates that a predetermined time interval has passed and that a regular communication with the host computer 4 is necessary or not. If it is determined that a regular communication is necessary, then the process moves to step S19. In step S19, the host computer 4 is called via the NCU 43 and the modem 47. When a line has been connected to the host computer 4 in step S19, various operating data for the copying machine 1 are sent to the host computer 4 in step S20. At this time, consumable item use data such as the number of sheets used for each paper supply cassette, and the toner replenishment count, held in the RAM 45, are sent to the host computer 4. In step S21, a judgment is made to determine whether or not a reset signal has been received from the host computer 4. If a reset signal has been received from the host computer 4 then the process moves to step S22. In step S22, data indicating the number of sheets used for each paper supply cassette, and the toner replenishment count, held in the RAM 45, are re-initialized and the values previously set in step S11 are replaced or updated. In step S23, communication with the host computer 4 ceases. The process then moves to step S24 and other operations are performed.

Figure 8:
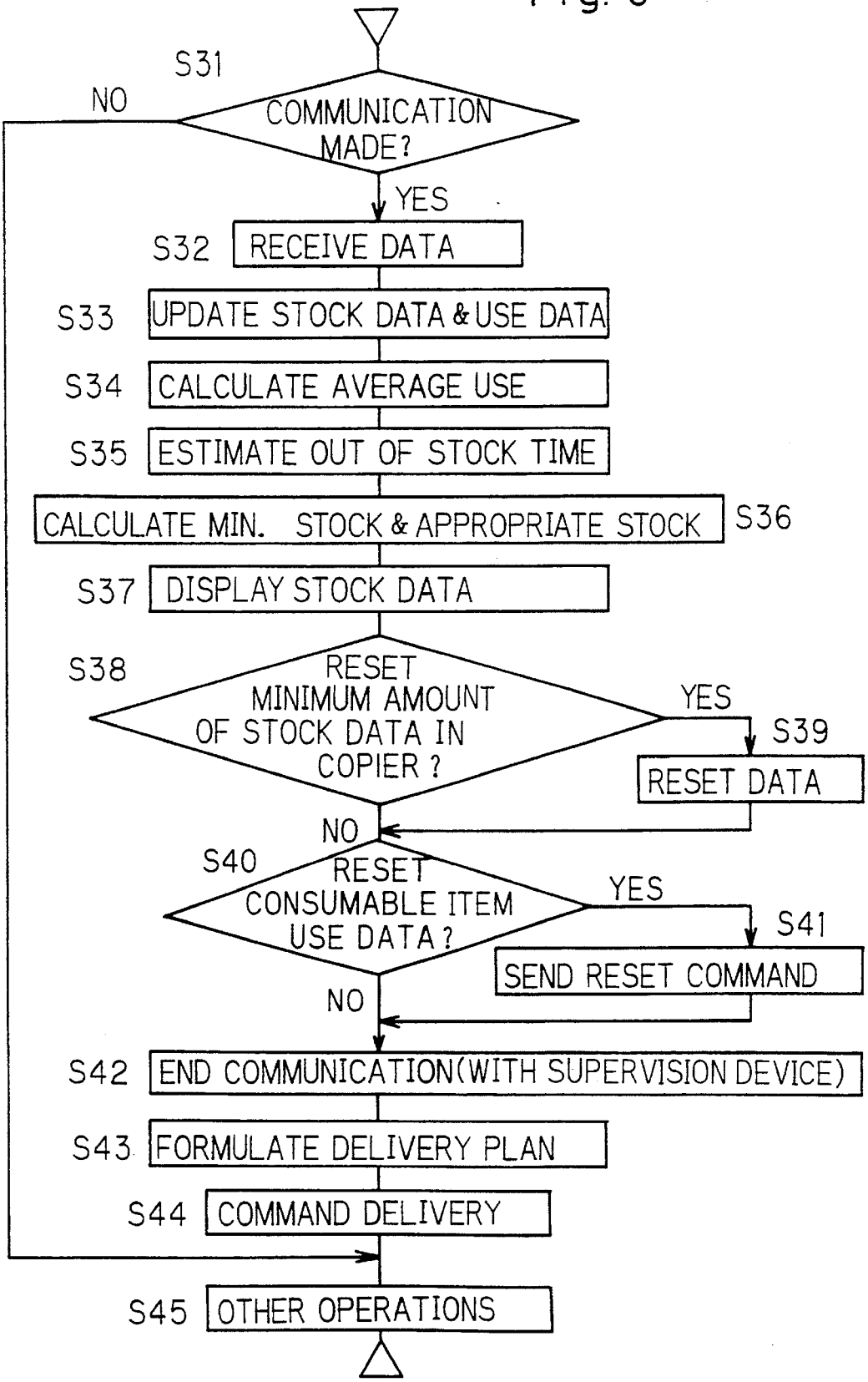
FIG. 8 is a flowchart showing the operation of the host computer in accordance with the first embodiment of the present invention.

In the first embodiment, the host computer 4 performs actions based on a flow chart as shown in FIG. 8.

In step S31, a determination is made as to whether or not a communication has been made from one of the copying machine supervision devices 2. If contact has been made from one copying machine supervision device 2, then the process moves to step S32. In step S32, the use data and stock data for the copying machine 1 which have been sent from the copying machine supervision device 2 are received. In step S33, the stock data and the use data from the corresponding copying machine 1 are updated in the copying machine supervision data base maintained in the storage device 57, based on the use data and stock data from the copying machine 1 which were received in step S32.

In step S34, average use data for the copying machine 1 are calculated based on the use data which was updated in step S33. For example, the average number of sheets used per day a, for each paper size is calculated based on the number of sheets of paper supplied from each paper supply cassette during the period from the previous communication to the present communication. The average use data a, can be calculated as a simple average from the time the copying machine 1 was installed, or can also be calculated as a most up-to-date moving average for a prescribed period. Further, the average number of days between replacement of the toner cartridge is found based on the toner replenishment count.

In step S35 the time when stocks will be exhausted is estimated based on the average use data calculated in step S35 and the stock data updated in step S33. For example, the stock data for each copying machine are supervised by personnel operating the host computer and monitoring the copying machine supervision data base constructed and maintained in the storage device 57. The host computer 4 is suited for usage in a maintenance center or dispatch center from where shipments of supplies, such a toner and paper, are delivered. Further, the dispatch center, upon observing that a toner overflow condition exists can dispatch a repairman, if the photocopying machine user cannot correct the condition. The information in the database allows personnel at the dispatch center to easily respond to the data compiled in the database and deliver paper and toner in accordance with the information in the database. After a delivery is sent to a site, the delivered amounts are added to the current stock amounts in the database. In this case the construction is such that when paper or toner are delivered from the dispatch center, for example, the delivered amounts are input by an operator and are automatically added to the stock amounts stored in memory in the host computer 4. The consumable item stock amounts in the copying machine supervision database are updated based on the use data sent from the copying machine supervision device 2. Furthermore, it is possible to estimate how many days the current amount of stock will be exhausted, based on the average use data calculated in step S34.

In step S36, required minimum amounts of stock and appropriate amounts of stock for the corresponding copying machine 1 are calculated based on the average use data calculated in step S34. If the out-of-stock time estimated in step S35 or the date the user puts in an order is taken as the expected delivery date, then there is a time lag $T_1$ between the expected delivery date and the actual delivery date (the date the supply order is actually received). Therefore the user must always have an amount of at least the minimum amount of stock $S_{min}$ based on the average use data and the time lag for the particular copying machine 1. For example, taking paper as the consumable item, (minimum amount of stock $S_{min}$)=(average number of sheets used a)×(time lag $T_1$). Here, if the actual delivery is performed on the day following the expected delivery date, and assuming that there are no deliveries on Saturday or Sunday, then if the expected delivery date is a Friday but the shipment is received the following Monday, then the time lag $T_1$ will be three days. Therefore, for paper of which the number of sheets used on average per day by the copying machine 1 is 500 sheets, the minimum amount of stock $S_{min}$=500×3=1500 sheets. Further, if a minimum amount of stock for the user is known, it is possible to determine the number of days between expected delivery dates on which the consumable item is regularly delivered, based on the minimum amount of stock and the average use data found in step S34. It is then possible to determine an appropriate amount of stock $S_p$ required .until the next regular delivery, based on the delivery interval, the average use data and the total amount of stock. In this case the following calculation can be performed: (appropriate amount of stock $S_p$)=(average amount used a)×(delivery interval k)+(minimum amount of stock $S_{min}$). Thus in the abovementioned example, if the delivery interval k=7, then the appropriate amount of stock will be Sp=500×7+1500=5000 sheets.

In step S37 the stock data in the database in the host computer 4 transmitted from the supervision device 2 currently in communication with the host computer 4 is displayed on the CRT 55. In step S38 a judgment is made to whether or not to reset the stock data stored in the supervision device 2, replacing the stock data currently in the supervision device 2 with the value of the minimum amount of stock calculated in step S36. If the minimum amount of stock needs to be reset then the process moves to step S39. In step S39 the minimum amount of stock calculated in step S36 is sent to the copying machine supervision device 2 currently in communication with the host computer 4 via the communications line 3.

In step S40, a judgment is made to determine whether or not to reset the consumable item use data for the copying machine supervision device 2 which is currently communicating. If the consumable item use data are to be reset then the process moves to S41. In step S41 a reset signal is sent to the copying machine supervision device which is currently communicating. In step S42, communication with the copying machine supervision device 2 which is communicating ceases.

In step S43 a delivery plan is formulated based on the out-of-stock time calculated in step S35. Here, the amount of consumable item to be delivered is determined based on the appropriate amount of stock calculated in step S36, and a delivery list is formed. In step S44, consumable item delivery commands are issued to the dispatch center, for example, based on the delivery plan list formed in step S43. Other operations are performed in step S45.

Figures 9A, 9B, 9C:
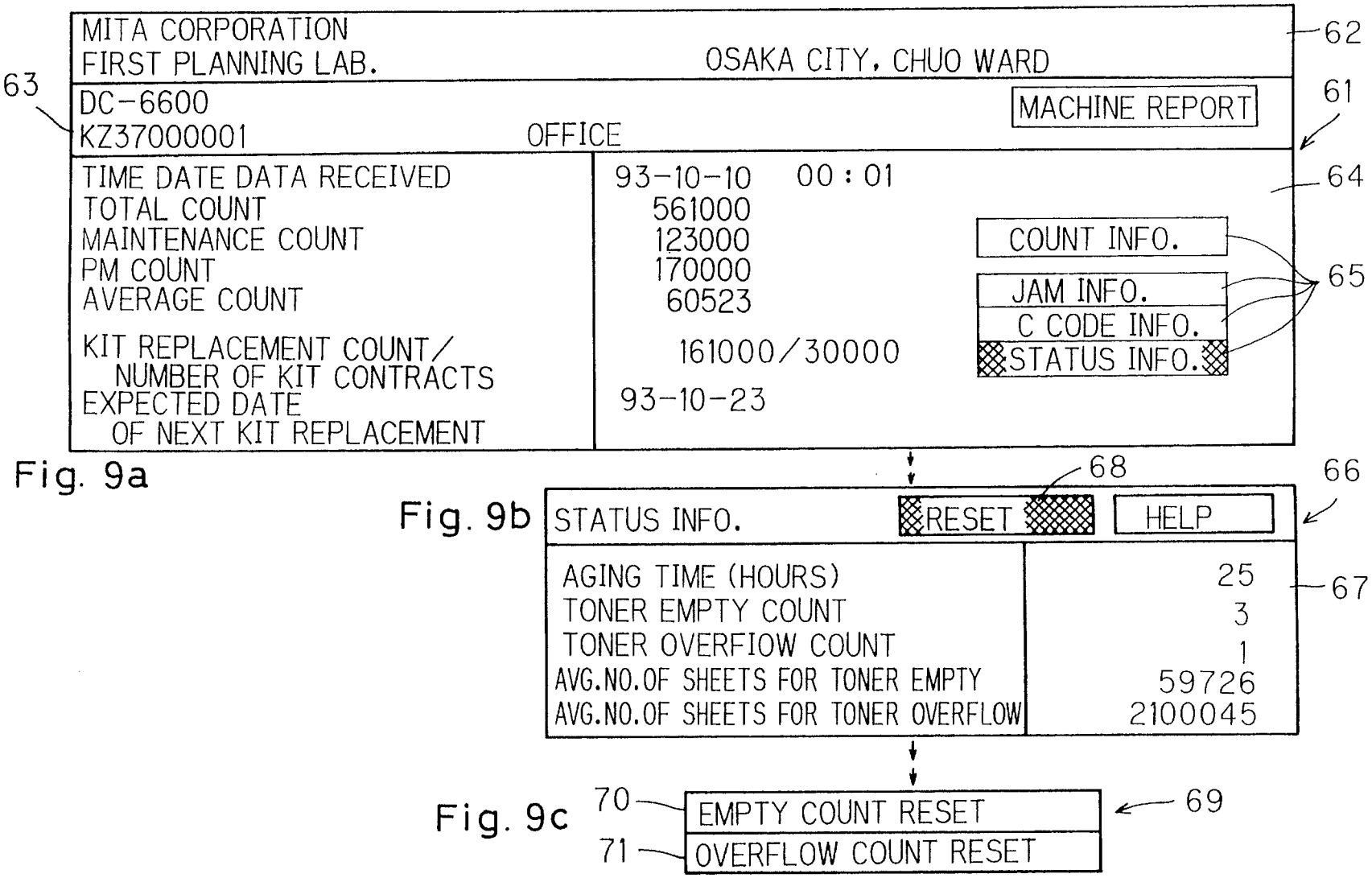
FIGS. 9*a*, 9*b* and 9*c* are a representations of an operating information screen displayed on a computer monitor of the host computer in response to actions represented in FIG. 8.

FIGS. 9*a*, 9*b* and 9*c* show operating information screens for a copying machine 1, displayed on the CRT 55 and produced in response to step S37 in FIG. 8. FIG. 9(*a*) is an example diagram of an operating information screen 61 which displays operating data for the copying machine 1. The upper level of the operating information screen 61 includes a user display area 62 which shows the location of the copying machine 1. Below the user display area 62 is a machine type display area 63 which indicates information such as the type of the copying machine 1. Below the machine type display area 63 is an operating data display area 64 which indicates the most recent time that data were received, the total number of copying actions and the maintenance count, for example. Further, information selection buttons 65 are provided in the operating data display area 64, and it is possible to display more detailed operating data by selecting the information selection buttons 65 on the screen. For example, if a "Status Information" button from the information selection buttons 65 in FIG. 9(*a*) is selected, then the Status Information screen 66 shown in FIG. 9(*b*) will be displayed. The Status Information screen 66 has an Information Display area 67 which displays status information such as the number of times the developer 9 has become empty of toner, the number of times toner has overflowed in the cleaning unit 11, the average number of sheets when the developer 9 has become empty of toner, and the average number of sheets when the cleaner unit 11 has overflowed with toner, and a reset selection button 68 for displaying a reset screen.

The status information displayed in the Information Display area 67 indicates the toner use data, and this is updated based on the use data sent from the copying machine supervision device 2 during communication. If the Reset Selection button 68 is selected on the screen, then a Reset Button Display screen 69 as shown in FIG. 9(*c*) is displayed. The Reset Button Display screen 69 displays an Empty Count Reset button 70 and an Overflow Count Reset button 71. If the tone Empty Count Reset or toner Overflow Count Reset button are selected in the Reset Button Display screen 69, then a reset signal is sent to the copying machine supervision device 2 in communication with the host computer 4. The amount of toner consumed can be found based on the number of times the developer 9 has become empty of toner, and the number of times the cleaner has overflowed with toner, but it is also possible to calculate the amount of toner consumed simply by counting only the number of times the developer 9 has become empty. Further, it is also possible to have a construction in which step S40 is omitted and a reset signal is automatically sent during communication. In this case, the number of times the developer has become empty of toner, held in the RAM 45 of the copying machine supervision device 2, will always be reset during regular communications. The number of times the toner has become empty in the copying machine 1, which information is held in the storage unit 57 of the host computer 4, is the most up-to-date toner replenishment count sent from the copying machine supervision device 2 during regular communications, and the current number in stock can be calculated by subtracting the number of times the developer 9 has become empty of toner from the number of toner cartridges with which the copying machine 1 is normally stocked. For example, if it is assumed that the copying machine 1 is normally stocked with four toner cartridges, and if the number of times the developer 9 has become empty is four, as communicated by the copying machine 1 during regular communications, then the amount of stock remaining on site with the photocopying machine 1 can be considered to be zero. It is therefore possible to formulate a delivery plan for delivering cartridges to the user, based on the details displayed in the information display area 67 after regular communications.

Figure 10:
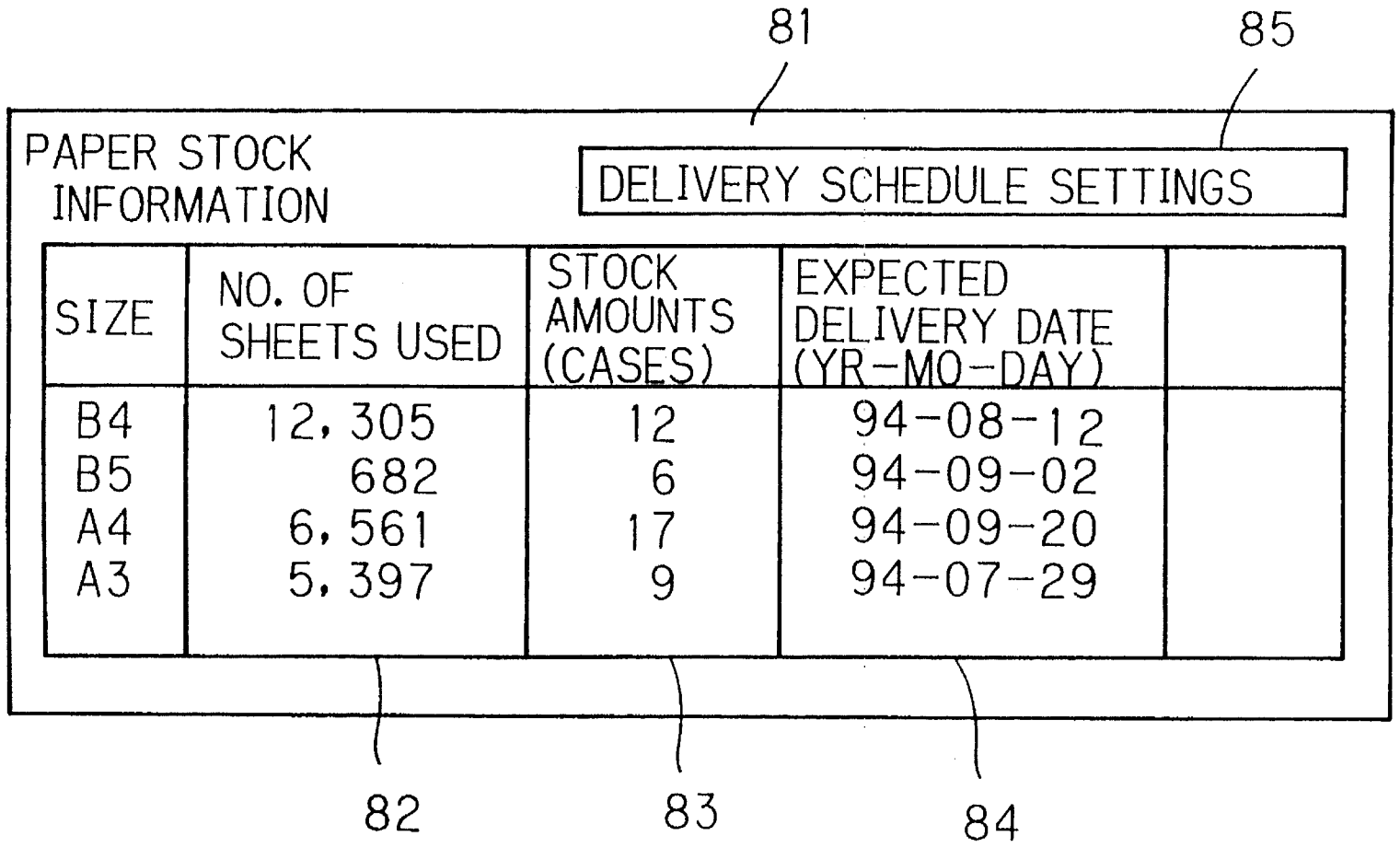
FIG. 10 is a representation of another screen displayed on the computer monitor of the host computer.

By selecting the Count Information button from the information selection button 65 in the operating information screen 61 shown in FIG. 9*a* it is possible to display a Paper Stock Information screen 81 as shown in FIG. 10. The Paper Stock Information screen 81 displays the number of sheets used by the corresponding copying machine 1 and the current amount of stock, in a No. Of Sheets Used area 82 and a Stock Amount area 83. The use data indicated in the No. of Sheets Used area 82 and the Stock Amount area 83 are updated to the most up-to-date use data in step S33 (FIG. 8). Further, an Expected Delivery Date area 84 indicates the out-of-stock time calculated in step S35. Furthermore, a Delivery Schedule Settings button 85 is provided at the top right of the Paper Stock Information screen 81.

Figure 11:
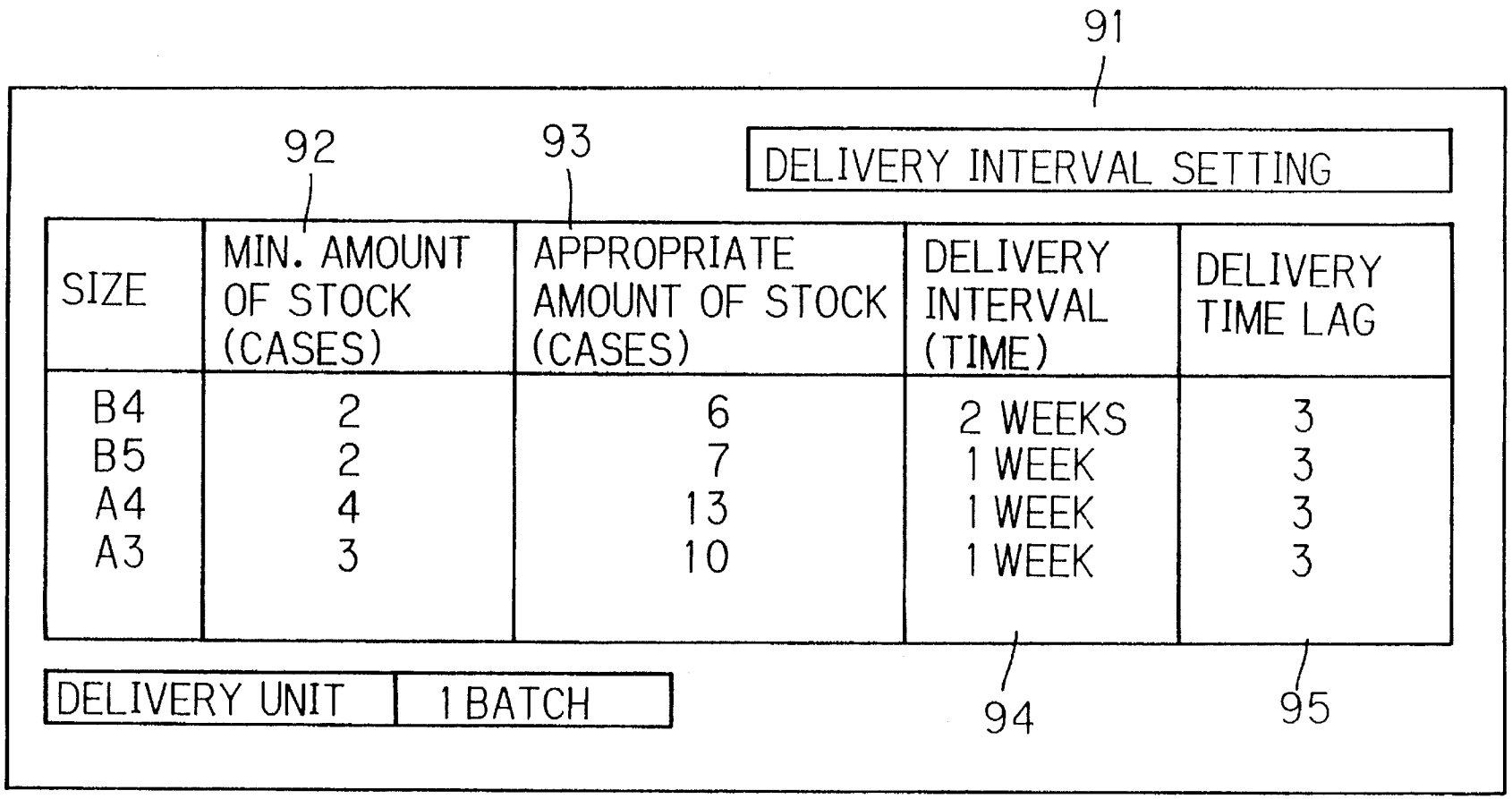
FIG. 11 is a representation of yet another screen displayed on the computer monitor of the host computer in accordance with the first embodiment of the present invention.

If the Delivery Schedule Settings button 85 in the Paper Stock Information screen 81 in FIG. 10 is selected then a delivery condition setting screen 91 shown in FIG. 11 is displayed. The Delivery Schedule Settings screen 91 is provided with a Min. Amount of Stock area 92, an Appropriate Amount of Stock area 93, a Delivery Interval area 94 and a Delivery Time Lag area 95. The Min. Amount of Stock area 92 displays the minimum amount of stock for each size, calculated in step S36. The "Appropriate Amount of Stock" area 93 displays the appropriate amount of stock for each size of paper, calculated in step S36. The "Delivery Interval" area 94 displays the delivery interval indicating the interval between the expected delivery dates for each size of paper. The "Delivery Time Lag" area 95 indicates the maximum time lag between the expected delivery date and the actual delivery date. For instance, the expected delivery date may be the date replacement stock is ordered or shipped out, and the anticipated delivery date is the actual delivery date or the date the shipment is received. By setting this maximum time lag, the minimum amount of stock is calculated in step S36 and is displayed in the minimum amount of stock area 92. Once the delivery time lag interval has been set, the appropriate amount of stock may be calculated in step S36, and the values in the appropriate amount of stock area 93 are automatically determined by the host computer 4.

A description has been given with respect to the first embodiment where stock supervision of paper was performed based on data indicating the number of sheets used for each size of paper. It is also possible to calculate the average toner replenishment interval based on the toner replenishment count monitored by the copying machine supervision device 2, and to formulate a toner cartridge delivery plan based thereupon.

In the imaging device according to the present invention, consumable item stock data and use data are supervised by a copying machine supervision device such that a determination can be made about the approach of an out-of-stock state by comparing the stock data with a predetermined value, and the current stock data and the use data sent to a host computer from the copying supervision device. Thus even though the host computer does not continuously supervise the imaging device stock data, it is possible to use the host computer to determine when stocks for the imaging device will be exhausted. It is therefore possible to reduce downtime due to stocks of consumable items in the imaging device becoming exhausted. It is further possible to reduce the stock supervision responsibility of users or maintenance personnel since there is no need for the user to perform excessive stock supervision.

If a minimum amount of stock, calculated based on the consumable item stock data and the use data, is used as the threshold for the copying machine supervision device, then it is possible for stock supervision by the user to be kept to a minimum.

Further, with the imaging device supervision system according to the present invention, a plurality of imaging devices are connectable to a single host computer via telephone lines, or network lines and if the consumable item stock data for any of the imaging devices drops below a prescribed threshold, communications are initiated with the host computer and the stock data and use data are transmitted. It is therefore not necessary for the host computer to perform consumable item stock supervision for each imaging device continuously. With a system in which the out-of-stock time for consumable items in each imaging device is estimated by the host computer, it is possible to perform relatively accurate stock supervision by means of communications, even if the amount of consumable item used by the imaging device exceeds the estimated amount, and it is thus possible to reduce the downtime.

If the host computer is constructed such that it calculates the minimum amount of stock based on the consumable item stock data and use data, and sets the minimum amount of stock as the threshold in the out-of-stock detection unit, then it is possible to perform accurate stock supervision based on the most up-to-date use data.

Further, if the host computer has a construction in which there is provided a delivery command function which formulates a delivery plan for the consumable items based on the stock data and the use data for the imaging device, it is possible to formulate an appropriate delivery plan based on the stock data and use data from each imaging device.

SECOND EMBODIMENT

It should be understood that various functions and configurations are possible of the present invention. Several alternate embodiments of the present invention are also described herein as examples thereof.

Figure 13:
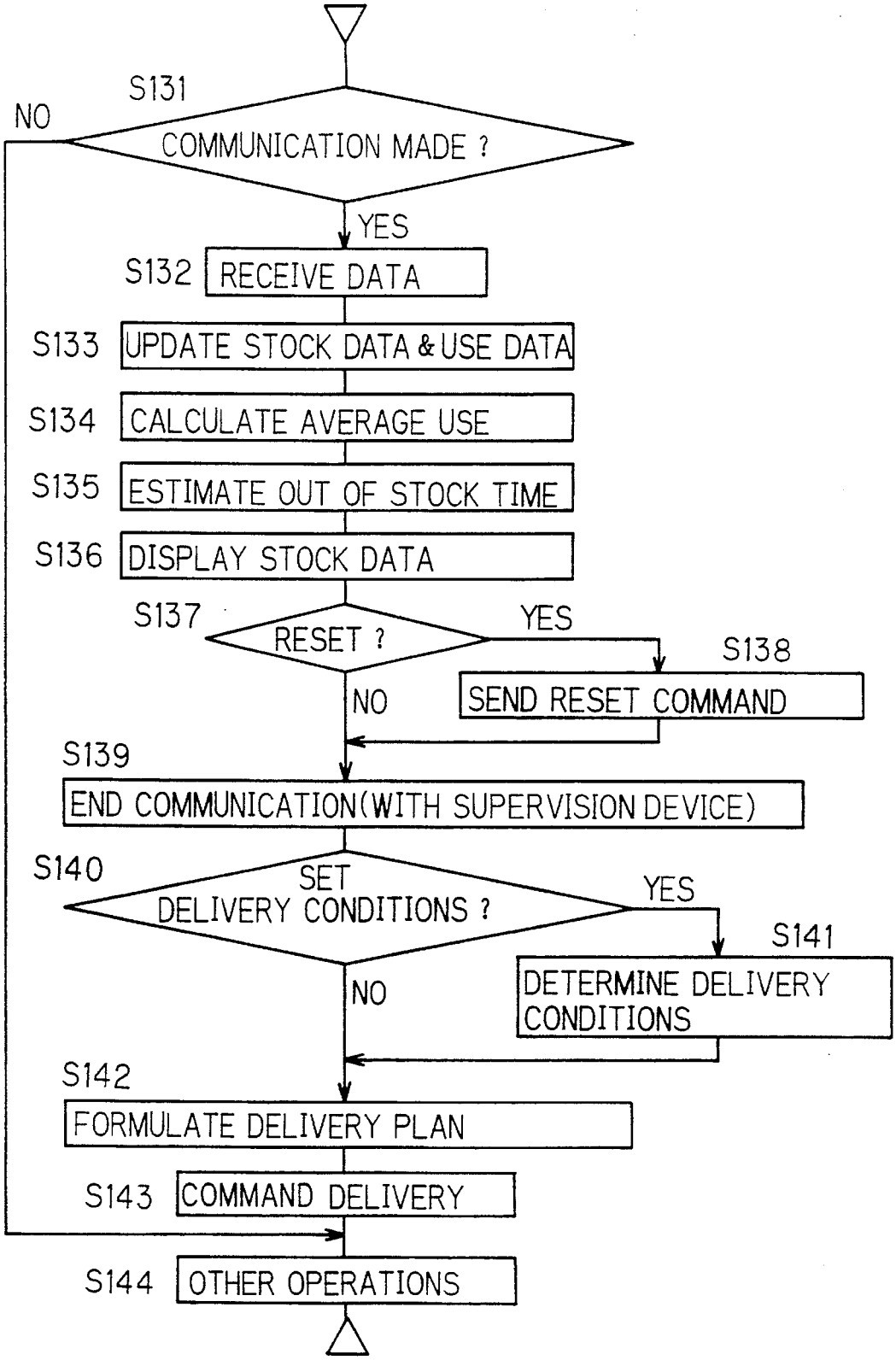
FIG. 13 is a flowchart showing the operation of the host computer in accordance with the second embodiment of the present invention.
Figure 14:
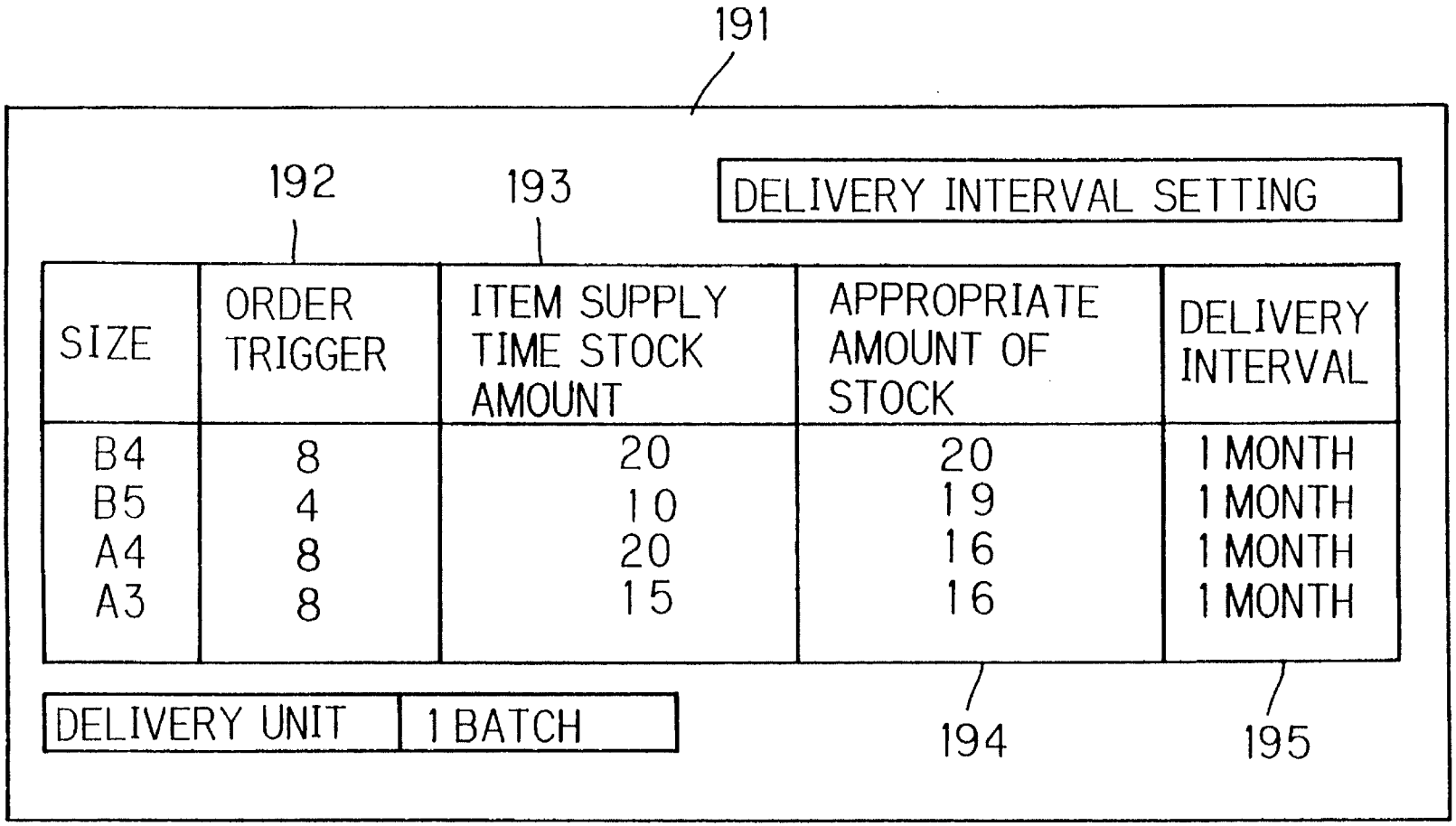
FIG. 14 is a representation of one screen displayed on the computer monitor of the host computer in accordance with the second embodiment of the present invention.

For instance, in a second embodiment, as shown in FIGS. 12 through FIG. 14, the copying machine supervision device 2 is configured to perform similar functions using slightly different actions than described with respect to FIGS. 7 and 8.

In step S111, a judgment is made to determine whether or not data have been received from the copying machine 1 indicating the number of sheets of paper supplied. If data indicating the number of sheets supplied from each of the paper supply cassettes 14, 15, 16 and 17 have been received by the copying machine supervision device 2, then the process moves to step S112 . In step S112, the data indicating the number of sheets used for each paper supply cassette in the copying machine 1, held in RAM 45, are updated based on the data indicating the number of sheets of paper used by the photocopying machine 1.

In step S113, a judgment is made to determine whether or not a toner exhausted signal (herein after toner-empty signal) has been received from the copying machine 1. If a toner-empty signal has been received from the copying machine 1 then the process moves to step S114. In step S114, the toner replacement count for the copying machine 1, held in RAM 45, is incremented. In step S115, the host computer 4 is communicated with via the NCU 43 and the modem 47. When, in step S115, communication with the host computer 4 has been established, in step S116 the toner replenishment count and data indicating the number of sheets used, and the like, held in RAM 45, are sent to the host computer 4. In step S117, a judgment is made to determine whether or not a reset signal has been received from the host computer 4. If a reset signal has been received from the host computer 4 then the process moves to step S118. In step S118, the toner replenishment count and data indicating the number of sheets used, held in RAM 45, are re-initialized. In step S119, communication with the host computer 4 is terminated and the process then moves to step S120.

In step S120, a judgment is made to determine whether or not the current time in the clock IC 46 indicates that a regular communication is necessary. If it is determined that a regular communication is necessary, then the process moves to step S121. In step S121, the host computer 4 is called via the NCU 43 and the modem 47 in the same way as in step S115. When, in step S121, communication with the host computer 4 has been established, in step S122 various items of operating data for the copying machine 1 are sent to the host computer 4. At this time consumable item use data such as data indicating the number of sheets used, held in RAM 45, are sent to the host computer 4. In step S123, a judgment is made to determine whether or not a reset signal has been received from the host computer 4. If a reset signal has been received from the host computer 4 then the process moves to step S124. In step S124 the data indicating the number of sheets used, held in RAM 45, are initialized. In step S125, communication with the host computer 4 is terminated. The process then moves to step S126. Other processes are performed in step S126.

In the second embodiment, the host computer 4 performs actions based on the flow chart as shown in FIG. 13.

In step S131, a judgment is made to determine whether or not a communication has been made from the copying machine supervision device 2. For instance, if there has been a telephone call from, or communications link established with the copying machine supervision device 2 then the process moves to step S132. In step S132, operating data from the copying machine 1 is sent from the operating machine supervision device 2 to the host computer 4. In step S133, the stock data and use data for the corresponding copying machine 1 in the copying machine supervision data base in the storage device 57 are updated based on the operating data for the copying machine 1 which were received in step S132. In step S134, consumable item average use data are calculated based on the consumable item stock data for the copying machine 1 and the use data, updated in step S133. For example, if the present communication with the copying machine supervision device 2 is a regular communication then data indicating the number of sheets supplied from each paper supply cassette in the copying machine 1 are sent as consumable item use data. It is therefore possible for the host computer 4 to calculate the number of sheets used on average per day for each paper size based on the use data from the previous communication and the use data from the present communication. The average use data can be calculated as a simple average from the time the copying machine 1 was installed, or can be calculated as a most up-to-date moving average for a prescribed period. Further, if communication has been performed due to the need for toner replenishment, the average number of days between replacement of the toner cartridge is found based on the toner replenishment count sent from the copying machine supervision device 2.

In step S135, the time when stocks will be exhausted is estimated based on the average use data calculated in step S134 and the stock data updated in step S133. For example, the amounts of stock for each copying machine 1 are supervised by means of a copying machine database which is maintained in the storage device 57 of the host computer 4, and in conjunction with a system in the dispatch center which delivers paper and toner, current stocks are supervised by adding the delivered amounts to the amounts in stock. The construction in this case is such that the delivered amounts are input by an operator when paper or toner are delivered from the dispatch center, for example, and the amounts are automatically added to the amounts in stock. Further, since the consumable item stock amounts in the copying machine supervision data base are updated based on the use data sent from each copying machine supervision device 2, it is possible to estimate after how many days current stocks will be exhausted, based on the average use data calculated in step S134. In step S136, consumable item stock data in the copying machine supervision database are displayed on the CRT 55.

In step S137, a judgment is made to determine whether or not to reset the consumable item use data held in the RAM 45 of the copying machine supervision device 2 with which communications are currently being performed. If the consumable item use data held in the copying machine supervision device 2 with which communications are currently being performed is to be reset then the process moves to step S138. In step S138, a reset signal is sent to the copying machine supervision device 2 with which communications are currently being performed. In step S139, communication with the copying machine supervision device 2 are terminated.

In step S140, a judgment is made to determine whether or not to set delivery conditions based on the time at which stocks will be exhausted, calculated in step S135. If delivery schedule settings are to be made, then the process moves to step S141. In step S141, a minimum stock amount (threshold) for performing automatic delivery, and a maximum stock amount when items have been supplied, are set based on the delivery interval.

In step S142, a consumable item delivery plan is formulated for the user of the copying machine 1. Here, in order that stocks held by the user should not become exhausted, the predicted day when stocks of the consumable item in the copying machine 1 will drop below a certain value is estimated, and a delivery plan list is formed such that consumable items are delivered by maintenance personnel before that day. In step S143, a consumable item delivery command is issued to the dispatch center or the like, based on the delivery plan list formed in step S142. Other processes are performed in step S144.

The operation information screen on the CRT 55 in step S136, is generally the same as that shown in FIGS. 9*a*, 9*b* and 9*c*, and described above with respect to the first embodiment.

As was indicated above, the amount of toner consumed can be found based on the number of times the developer 9 has become empty of toner, and the number of times the cleaner has overflowed with toner, but it is also possible to calculate the amount of toner consumed simply by counting the number of times the toner has become empty. Further, it is also possible to have a construction in which step S140 is omitted and a reset signal is automatically sent during communication. In this case, the number of times the toner has become empty, held in the RAM 45 of the copying machine supervision device 2, will always be reset during regular communications. The number of times the toner has become empty in the copying machine 1, which information is held in the storage unit 57 of the host computer 4, is the most up-to-date toner replenishment count sent from the copying machine supervision device 2 during regular communications, and the current number in stock can be calculated by subtracting the number of times the toner has become empty from the number of toner cartridges with which the copying machine 1 is normally stocked. For example, if it is assumed that the copying machine 1 is normally stocked with four toner cartridges, and if the number of times the toner has become empty is four, as communicated by the copying machine 1 to the supervision device 2 and from the supervision device 2 to the host computer 4 during regular communications, then the amount of stock with the user can be considered to be zero. It is therefore possible to formulate a delivery plan for delivering cartridges to the user, based on the details displayed in the information display area 67 in FIG. 9*c* after regular communications with the supervision device 2.

In step S141, the current stock of supplies at the photocopying machine site is determined for each size paper used in the photocopying machine 1. If supplies are low and re-stocking of supplies is necessary, the host computer 4 can determine the amount of each size of paper that needs to be delivered based upon the information in the database in the host computer 4 and displayed on the operating information screen 61 in FIG. 9(*a*). By selecting the count information button from the information selection button 65 on the operating information screen 61, the paper supervision information screen as shown in FIG. 10 can be displayed. The paper supervision information screen 81 displays the number of sheets used and the current stock in the corresponding copying machine 1, in a number of sheets used area 82 and a current stock amount area 83. The use data shown in the number of sheets used area 82 and the stock amount area 83 are updated in step S133 to the most up-to-date use data. Further, an expected delivery date area 84 indicates the time at which stocks will be exhausted, calculated in step S135.

If Delivery Schedule Settings button 85, which is located at the top right of the Paper Supervision Information screen 81 in FIG. 10 is selected, then a Delivery Schedule Setting screen 191 is displayed on the CRT 55, as shown in FIG. 14. The screen shown in FIG. 14 is slightly different that the screen shown in FIG. 11 described with respect to the first embodiment. The Delivery Schedule Setting screen 191 in FIG. 14 has an Order Trigger area 192 which displays a threshold used to determine whether or not it is necessary for a delivery of supplies to be made. If the stock on the site of the photocopying machine 1 falls below the threshold value, then a delivery is needed. Numeric values inputted into a Item Supply Time Stock Amount area 193 indicate a maximum amount of stock which is to be supplied. An Appropriate Amount of Stock area 194 displays a determined appropriate amount of stock which should be delivered to the site of the photocopying machine. The value in the area 194 is determined based on the expected delivery date, the value in a Delivery Interval area 195 and other values.

Average use data for each paper size in the copying machine 1 are calculated from the use data transmitted during regular communications, and by preselecting the data in the Delivery Interval area 85 on the intervals when deliveries are made from the dispatch center. It is possible to calculate and set automatically the appropriate amount of stock in the Appropriate Amount of Stock area 194 based on the delivery interval 195 and the calculated average use data.

Considering the time lag between a delivery command being sent to the dispatch center, for example, and the time the consumable item is actually delivered to the user, the amount which is thought to be used during this interval by the user is set as the threshold in the order trigger area 192. The maximum amount of stock when items have been supplied is determined based on the appropriate amount of stock, and is set in the area 194. It is assumed that the amount of stock held by the user on the expected delivery date will be approximately the same amount as the threshold set in the order trigger area 192. Thus a command is issued to have a delivery on the expected delivery date with an order amount equal to the threshold value in the Order Trigger area 192, subtracted from the maximum amount of stock set in the area 193.

In this way it is possible for the host computer 4 to supervise amounts of stock of paper of each size and of toner cartridges in each copying machine 1, and therefore delivery orders can be issued efficiently.

In FIG. 12, the copying machine supervision device 2 is constructed such that it performs communication with the host computer when a toner-empty signal is received from the copying machine 1, but it is also possible to have a construction in which step S115 through step S119 in FIG. 12 are omitted, and the toner replenishment count is also sent during regular communications.

With the imaging device supervision system according to the present invention, the time at which stocks will be exhausted is estimated based on consumable item stock data and use data for an imaging device, and it is therefore possible to formulate an appropriate consumable item delivery plan before stocks of the consumable item in each imaging device are exhausted.

THIRD EMBODIMENT

Figure 15:
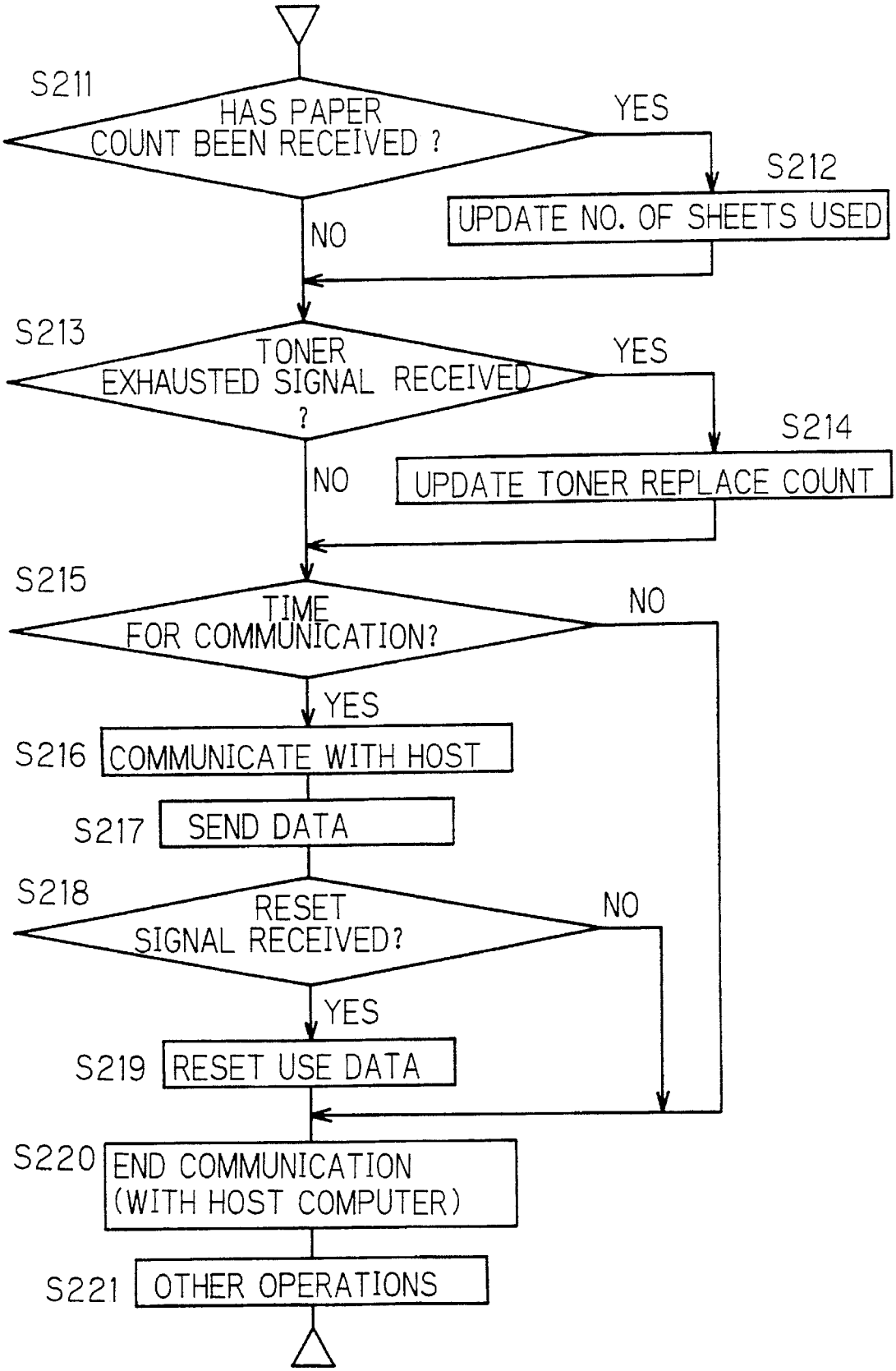
FIG. 15 is a flowchart showing the operation of the photocopier machine supervision device depicted in FIGS. 1 and 4, in accordance with a third embodiment of the present invention.

In a third embodiment, the copying machine supervision device 2 is configured to perform the operation actions as shown in FIG. 15. In step S211 a judgment is made to determine whether or not data indicating the number of sheets used from each paper supply cassette have been received from the copying machine 1. If data indicating the number of sheets used from each paper supply cassette have been received from the copying machine 1 then the process moves to step S212. In step S212, the data indicating the number of sheets used from each paper supply cassette, held in RAM 45, are updated.

In step S213, a judgment is made to determine whether or not a toner-empty signal has been received from the copying machine 1. If a toner-empty signal has been received then the process moves to step S214. In step S214, the tone replenishment count held in RAM 45 is incremented.

In step S215, a judgment is made to determine whether or not the current time indicated by the clock IC 46 is a regular communication time. If it is a regular communication time then the process moves to step S216. In step S216, communications are performed with the host computer 4 via the NCU 43, the modem 47 and the telecommunications line 3 or a network line or the like. In step S217, various operating data for the copying machine which are held in the RAM 45 are sent to the host computer 4. The data transmitted from the supervision device 2 to the host computer 4 includes use data such as the number of sheets used from each paper supply cassette, and the toner replenishment count. In step S218, a judgment is made to determine whether or not a reset signal has been received from the host computer 4. If a reset signal has been received from the host computer 4 then the process moves to step S219. In step S219, the data indicating the number of sheets used from each paper supply cassette, and the toner replenishment count, held in the RAM 45, are reset. In step S220, communication with the host computer 4 is terminated. The process then moves to step S221, where other processes are performed.

A description will now be given, using the flow chart in FIG. 16, of the actions of the host computer 4 when there is a communication from the copying machine supervision device 2.

In step S231 a judgment is made to determine whether or not there has been a communication from the copying machine supervision device 2. If there has been a communication from the copying machine supervision 2 then the process moves step S232. In step S232, various items of operating data for the copying machine 1 which have been sent from the operating machine supervision device 2 are received. In step S233, use data compiled in the copying machine supervision database stored and maintained in the storage device 57 are updated based upon the number of sheets used from each paper supply cassette, and the toner replenishment count, etc., from the various data received in step S232. At the same time, the current consumable item stock data for the corresponding copying machine 1 are also updated. In step S234, average use data are calculated based on the consumable item use data which were updated in step S233. For example, the average number of sheets used per day, a, for each paper size is calculated based on the data indicating the number of sheets used from each paper supply cassette from the time of the previous communication to the time of the present communication. The average number of sheets used, a, can be calculated as a simple average from the time the copying machine 1 was installed or can also be calculated as a most up-to-date moving average for a set period. For the toner replenishment count, the average number of days between toner replenishment is calculated based on the dates on which toner-empty signals were generated.

In step S235, the time at which stocks of the consumable item in the corresponding copying machine 1 will be exhausted is estimated based on the average use data calculated in step S234 and the stock data updated in step S233. For example, the amounts of stock for each copying machine 1 are maintained in a copying machine supervision data base which is stored and maintained in the storage device 57 of the host computer 4. Personnel at a dispatch center, in response to information in the database, have supplies delivered when needed. The host computer 4 then adds the delivered stock amounts to the known current stock amounts, thus updating the amounts to reflect the delivered stocks. In this case the construction is such that when paper or toner are delivered from the dispatch center, for example, the delivered amounts are input by an operator and are automatically added to the stock amounts. Further, the consumable item stock amounts in the copying machine supervision database are updated based on the use data sent from the copying machine supervision device 2, and it is thus possible to estimate after how many days the current amount of stock will be exhausted, based on the average use data calculated in step S234.

In step S236, required minimum amounts of stock and appropriate amounts of stock for the corresponding copying machine 1 are calculated based on the average use data calculated in step S234. If the out-of-stock time estimated in step S235 or the date the user puts in an order is taken as the expected delivery date, then there is a time lag $T_1$ between the expected delivery date and the actual delivery date. Therefore the user must always have an amount of at least the minimum amount of stock $S_{min}$ based on the average use data and the time lag for the copying machine 1. For example, taking paper as the consumable item, (minimum amount of stock $S_{min}$)=(average number of sheets used a)×(time lag $T_1$). Here, if actual delivery is on the day following the expected delivery date, and assuming that there are no deliveries on Saturday or Sunday, then if the expected delivery date is a Friday then the actual delivery date will be a Monday, and the time lag $T_1$ will be three days. Therefore for paper of which the number of sheets used on average per day by the copying machine 1 is 500 sheets, the minimum amount of stock $S_{min}$=500×3=1500 sheets. Further, if a minimum amount of stock for the user is set, it is possible to determine the number of days between expected delivery dates on which the consumable item is regularly delivered, based on the minimum amount of stock and the average use data found in step S234. It is then possible to determine an appropriate amount of stock $S_p$ required until the next regular delivery, based on the delivery interval, the average use data and the minimum amount of stock. In this case the following calculation can be performed: (appropriate amount of stock $S_p$)=(average number of sheets used a)×(delivery interval k)+(minimum amount of stock $S_{min}$). Thus in the abovementioned example, if the delivery interval k=7, then the appropriate amount of stock will be $S_p$=500×7+1500=5000 sheets.

In step S237 the stock data for the copying machine 1, based on the copying machine supervision data base in the storage device 57, are displayed via the CRT 55. In step S238 a judgment is made to determine whether or not to reset the consumable item use data which are stored in the copying machine supervision device 2 which is currently communicating. This judgment decides whether or not to wait for the operator of the host computer to make an input onto the screen, using the stock data display screen displayed in step S237, and then perform a reset. If the consumable item use data are to be reset then the process moves to step S239. In step S239, a reset signal which resets the consumable item use data such as the number of sheets used from each paper supply cassette and the toner replenishment count, is sent to the copying machine supervision device 2 which is currently performing communications. In step S240, communication with the copying machine supervision device 2 ceases.

In step S241 a plan for delivering a consumable item to the user is formulated based on the average use data calculated in step S234, the time at which stocks of the consumable item will be exhausted, calculated in step S235, and the appropriate amount of stock, calculated in step S236, for example. In step S242 delivery commands are issued to the dispatch center, for example, based on the delivery plan formulated in step S241. Other operations are performed in step S243.

Figure 16:
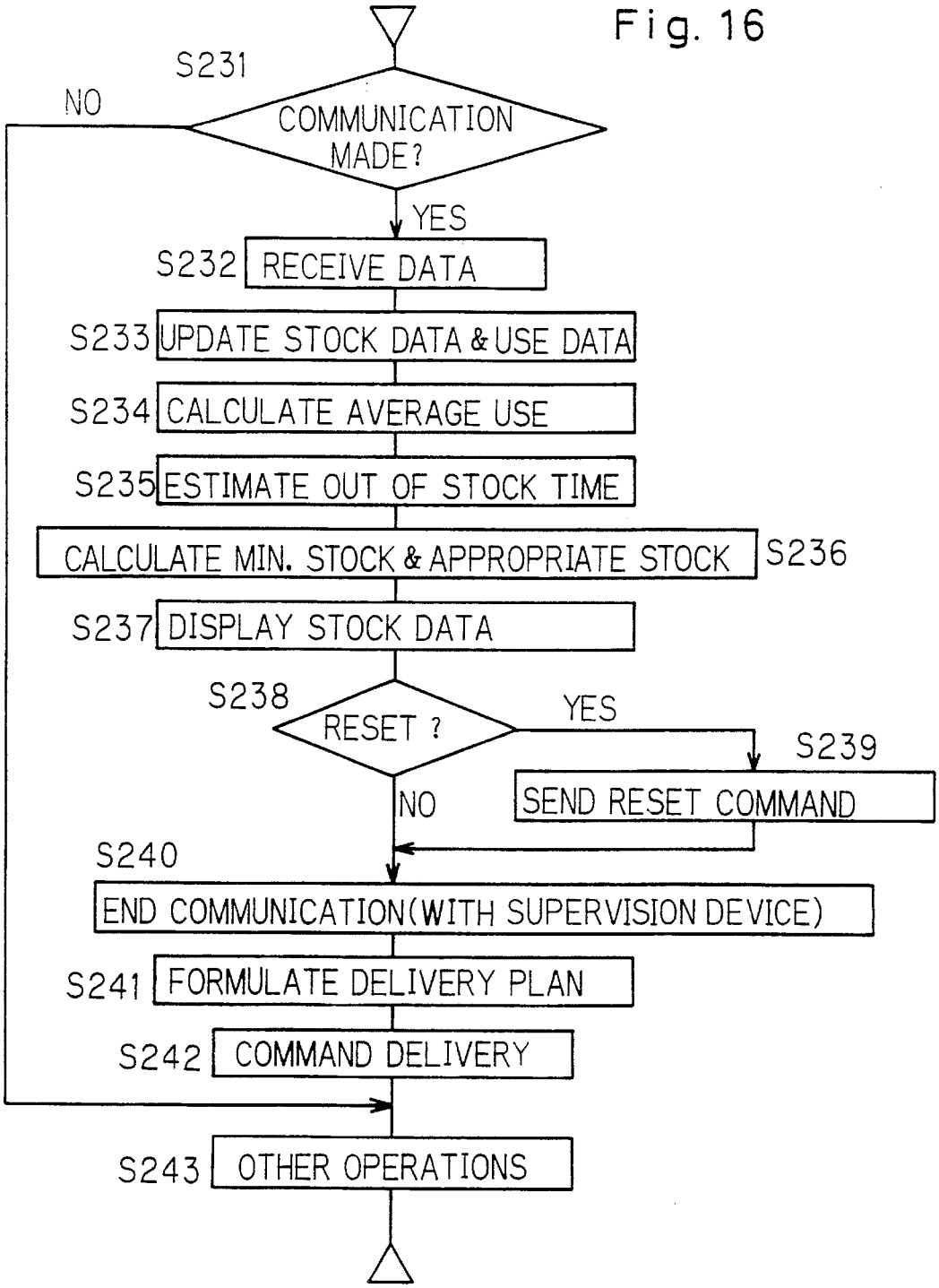
FIG. 16 is a flowchart showing the operation of the host computer in accordance with the third embodiment of the present invention.

FIGS. 9*a*, 9*b* and 9*c* show operating information screens for the copying machine 1 in accordance with the third embodiment, as produced in step S237 in FIG. 16. FIGS. 9*a*, 9*b* and 9*c* have already been described with respect to the first embodiment, and are applicable to the third embodiment.

In the third embodiment, the amount of toner consumed can be found based on the number of times the developer 9 has become empty of toner, and the number of times the cleaner 11 has overflowed with toner, but it is also possible to calculate the amount of toner consumed simply by counting the number of times the toner has become empty. Further, it is also possible to omit step S238, thereby sending a reset signal whenever a communication is performed. In this case, the toner replenishment count held in the RAM 45 of the copying machine supervision device 2 will always be reset during regular communications. The number of times the toner has become empty in the copying machine 1, which information is held in the storage unit 57 of the host computer 4, is the most up-to-date toner replenishment count sent from the copying machine supervision device 2 during regular communications. Thus the current number in stock can be calculated by subtracting the number of times the toner has become empty from the number of toner cartridges with which the copying machine 1 is normally stocked.

FOURTH EMBODIMENT

In a fourth embodiment, the copying machine supervision device 2 performs actions generally the same as those shown in FIG. 15 and described above with respect to the third embodiment.

Figure 17:
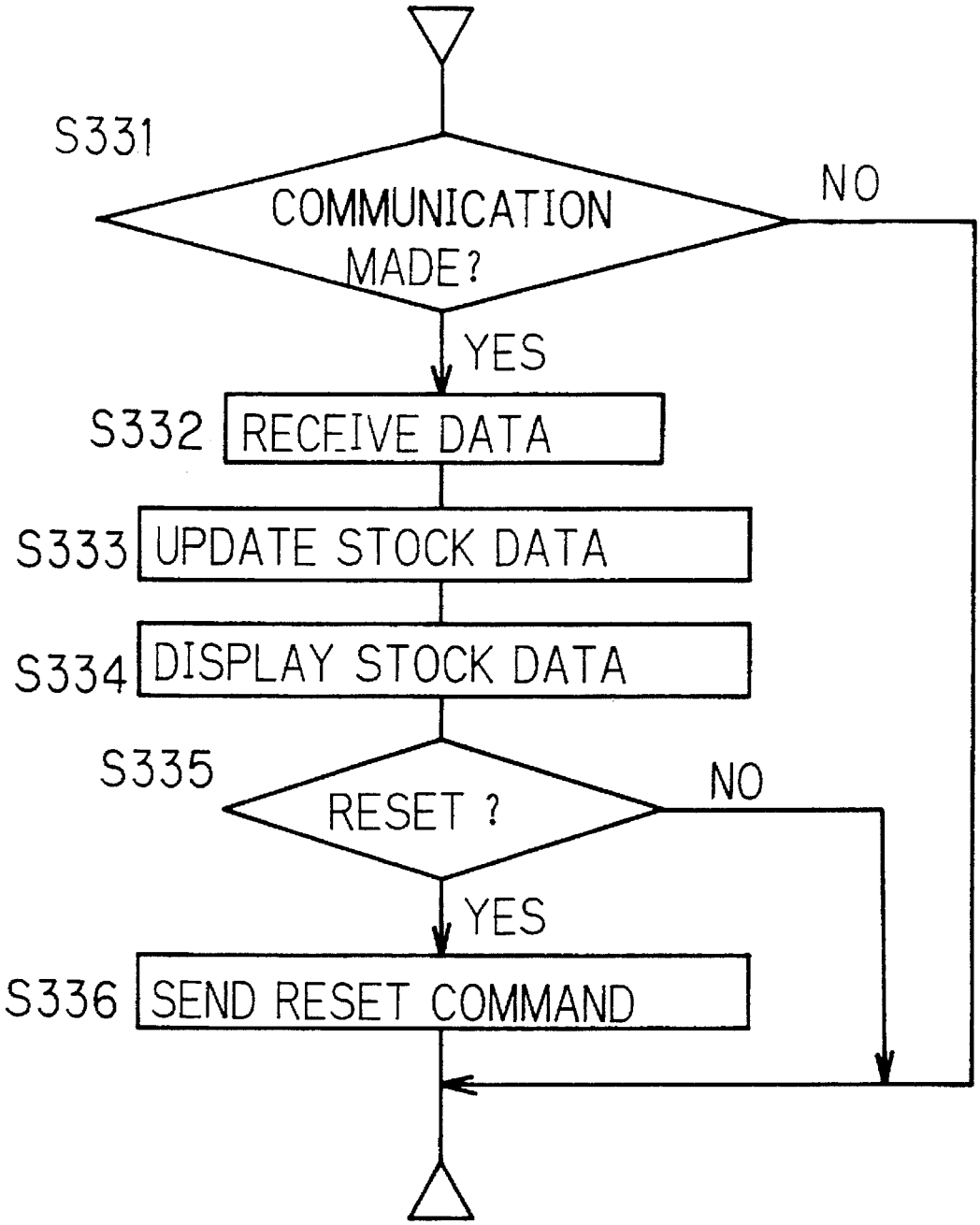
FIG. 17 is a flowchart showing the operation of the host computer in accordance with a fourth embodiment of the present invention.

However, the action of the host computer 4 when it has been contacted by the copying machine supervision device 2 operates as explained using the flow chart in FIG. 17.

In step S331 a judgment is made to determine whether or not there has been a communication from the copying machine supervision device 2. If there has been a communication from the copying machine supervision 2 then the process moves step S332. In step S332, various items of operating data for the Copying machine 1 which have been sent from the operating machine supervision device 2 are received. In step S333, use data in the copying machine supervision database which has been set in the storage device 57 are updated based on consumable item use data such as the data indicating the number of sheets used from each paper supply cassette, and the toner replenishment count, from the various items of operating data received in step S332. At the same time, the current consumable item stock data for the corresponding copying machine 1 are also updated. In step S334, stock data for the copying machine 1 with which communication is currently being performed are displayed using the CRT 55, based on the data base in the storage unit 57. In step S335, a judgment is made to determine whether or not to reset the consumable item use data stored in the copying machine supervision device 2 with which communications are currently being performed. In this decision it is determined whether or not to wait for the operator of the host computer to make an input onto the screen, using the stock data display screen displayed in step S334, and perform a reset. If a reset is to be performed then the process moves to step S336. In step S336, a reset signal which resets consumable item use data, here the data indicating the number of sheets used from each paper supply cassette and the toner replenishment count, is sent to the copying machine supervision device 2 with which communication is currently being performed.

FIGS. 9*a*, 9*b* and 9*c* show the operating information screen for a copying machine 1, as would be indicated in response to step S334 in FIG. 17.

As with the preceding embodiment, the amount of toner consumed can be found based on the number of times the cleaner 9 has become empty of toner, and the number of times the toner has overflowed in the cleaner 11, and the amount of toner consumed can be calculated simply by counting the number of times the toner has become empty. Further, it is also possible to have a construction in which step S335 is omitted and a reset signal is automatically sent during communication. In this case, the number of times the toner has become empty, held in the RAM 45 of the copying machine supervision device 2, will always be reset during regular communications. The number of times the toner has become empty in the copying machine 1, which information is held in the storage unit 57 of the host computer 4, is the most up-to-date toner replenishment count sent from the copying machine supervision device 2 during regular communications, and the current number of toner cartridges in stock can be calculated by subtracting the number of times the toner has become empty from the number of toner cartridges with which the copying machine 1 is normally stocked. For example, if it is assumed that the copying machine 1 is normally stocked with four toner cartridges, and if the number of times the toner has become empty is four, as communicated by the copying machine 1 during regular communications, then the amount of stock with the user can be considered to be zero.

With the imaging device supervision system according to the present invention, consumable item stock data which are supervised by a stock supervision unit are updated based on consumable item use data for an imaging device, and it is therefore possible to perform accurate consumable item stock supervision.

If the imaging device is provided with a communications control unit which communicates with a host computer which is connected via a line, it is possible to send consumable item use data for the imaging device from the use data supervision unit to the host computer via the line, and it is therefore possible for the host computer to perform consumable item stock supervision for each imaging device, and it is possible for stocks of consumable items to be recognized accurately by the host computer. It is therefore possible for the host computer to formulate a plan for delivering consumable items to the user, and it is thus possible for downtime of the imaging device to be reduced accurately.

With a construction in which the communications control unit provided in the imaging device communicates regularly with the host computer, it is possible for consumable item use data to be sent to the host computer using the regular communications, and it is thus possible to supervise accurately the consumable item stock data for each imaging device.

with a construction in which toner use data are supervised based on toner-empty signals issued by the imaging device, it is possible to supervise accurately stocks of toner cartridges, which are one of the consumable items in an imaging device, and it is thus possible to reduce the downtime of the imaging device.

Various details of the invention may be changed without departing from its spirit nor its scope. Furthermore, the foregoing description of the embodiments according to the present invention is provided for the purpose of illustration only, and not for the purpose of limiting the invention as defined by the appended claims and their equivalents.

What is claimed:

1. An imaging device supervision system comprising:

an imaging device having associated therewith a supply of consumable items;

a stock supervision device electronically connected to said imaging device, said stock supervision device being configured to electronically store stock data relating to said supply of consumable items and said stock supervision device configured to update said stock data based on use data transmitted from said imaging device to said stock supervision device; and a stock estimating device connected to said stock supervision device, said stock estimating device configured to estimate a time interval in which said supply of consumable items of said imaging device becomes exhausted in response to communications with said stock supervision device;

wherein said stock estimating device calculates average use data based upon said use data, calculates an estimated amount of consumable items used between a current date and an expected delivery date based upon said average use data, calculates a required minimum amount of stock based on a time lag between said expected delivery date and an actual delivery date, and calculates an appropriate amount of stock based on said minimum amount of stock and said estimated amount of consumable items used.

2. The imaging device supervision system as in claim 1 wherein said stock supervision device is connected to at least one sensor within said imaging device which monitors paper usage within said imaging device.

3. The imaging device supervision system as in claim 1, wherein said imaging device is a photocopying machine and said stock supervision device is connected to at least one sensor within said photocopying machine which monitors for a toner empty condition.

4. The imaging device supervision system as in claim 1 wherein said imaging device is a photocopying machine and said stock supervision device is connected to a controller within said imaging device.

5. The imaging device supervision system as in claim 1, wherein said-stock estimating device is a host computer having electronic communication means connectable with a plurality of said supervision devices.

6. The imaging device supervision system as in claim 5 wherein said stock supervision device communicates at predetermined time intervals with said host computer.

7. The imaging device supervision system as in claim 5, wherein said stock supervision device transmits to said host computer a paper supply count for each size of paper in said imaging device.

8. The imaging device supervision system as in claim 5, wherein said stock supervision device initiates communications with said host computer in response to a predetermined variation in said use data.

9. The imaging device supervision system as in claim 8, wherein said stock supervision device communicates with said host computer in response to a toner-empty signal from said imaging device.

10. The imaging device supervision system as in claim 5, wherein said host computer is configured to calculate a delivery stock order of consumable items to add to said supply of consumable items in response to data transmitted from said stock supervision device to said host computer.

11. An imaging device supervision system comprising:

an imaging device;

a supervision device in electronic communication with said imaging device, said supervision device being configured to electronically store stock data and use data, said supervision device updating said stock data in response to said use data being transmitted from said imaging device; and a host computer in electronic communication with said supervision device, wherein said supervision device being configured to compare said use data with said stock data and communicate with said host computer in response to the comparison between said use data and said stock data and transmit said use data to said host computer;

wherein said host computer calculates average use data based upon said use data, calculates an estimated amount of consumable items used between a current date and an expected delivery date based upon said average use data, calculates a required minimum amount of stock based on a time lag between said expected delivery date and an actual delivery date, and calculates an appropriate amount of stock based on said minimum amount of stock and said estimated amount of consumable items used.

12. The imaging device supervision system as in claim 11, wherein said stock data includes a threshold value corresponding to said minimum amount of stock calculated based on previous use data.

13. The imaging device supervision system as in claim 11, wherein said host computer includes a display means which displays said stock data.

14. A method for monitoring supplies of consumable items used by an imaging device comprising the steps of:

providing an imaging device with means for sensing paper usage and toner usage and a supply of paper proximate the imaging device;

transmitting use data indicating paper usage to a supervision device from the imaging device;

transmitting use data from the supervision device to a host computer, the host computer maintaining a database having information about the supply of paper proximate the imaging device;

calculating average use data based upon said use data;

calculating an estimated amount of consumable items used between a current date and an expected delivery date based upon said average use data;

calculating a required minimum amount of stock based on a time lag between said expected delivery date and an actual delivery date; and calculating an appropriate amount of stock based on said minimum amount of stock and said estimated amount of consumable items used.

15. A method as set forth in claims 14 further comprising the step of displaying data generated by said host computer on a display monitor.

16. A method for monitoring supplies of consumable items used by an imaging device comprising the steps of:

providing an imaging device with means for sensing paper usage and toner usage and a supply of paper and toner proximate the imaging device;

transmitting use data indicating paper usage and toner usage to a supervision device from the imaging device;

transmitting use data from the supervision device to a host computer, the host computer maintaining a database having information about the supply of paper and toner proximate the imaging device;

calculating average use data based upon said use data;

calculating an estimated amount of consumable items used between a current date and an expected delivery date based upon said average use data;

calculating a required minimum amount of stock based on a time lag between said expected delivery date and an actual delivery date; and calculating an appropriate amount of stock based on said minimum amount of stock and said estimated amount of consumable items used.

17. A method as set forth in claim 16 further comprising the step of displaying data generated by said host computer on a display monitor.

18. An imaging device supervision system comprising:

an imaging device having associated therewith a supply of consumable items;

a stock supervision device electronically connected to said imaging device, said stock supervision device being configured to electronically store stock data relating to said supply of consumable items, and to update said stock data based on use data transmitted from said imaging device to said stock supervision device; and a host computer connected to said stock supervision device, said host computer configured to estimate a time interval in which said supply of consumable items of said imaging device becomes exhausted in response to communications with said stock supervision device, and having electronic communication means connectable with said stock supervision device;

wherein said stock supervision device initiates communications with said host computer in response to a predetermined variation in said use data or a toner-empty signal from said imaging device; and said host computer calculates average use data based upon said use data, calculates an estimated amount of consumable items used between a current date and an expected delivery date based upon said average use data, calculates a required minimum amount of stock based on a time lag between said expected delivery date and an actual delivery date, and calculates an appropriate amount of stock based on said minimum amount of stock and said estimated amount of consumable items used.

19. The imaging device supervision system as in claim 18 wherein said stock supervision device is connected to at least one sensor within said imaging device which monitors paper usage within said imaging device.

20. The imaging device supervision system as in claim 18, wherein said imaging device is a photocopying machine and said stock supervision device is connected to at least one sensor within said photocopying machine which monitors for a toner empty condition.

21. The imaging device supervision system as in claim 18 wherein said imaging device is a photocopying machine and said stock supervision device is connected to a controller within said imaging device.

22. The imaging device supervision system as in claim 18, wherein said host computer calculates average use data for said imaging device, based on said use data, and estimates the time at which stocks of said consumable items will be exhausted, based on said stock data and said average use data.

23. The imaging device supervision system as in claim 18 wherein said stock supervision device communicates at predetermined time intervals with said host computer.

24. The imaging device supervision system as in claim 18, wherein said stock supervision device transmits to said host computer a paper supply count for each size of paper in said imaging device.

25. The imaging device supervision system as in claim 18, wherein said host computer is configured to calculate a delivery stock order of consumable items to add to said supply of consumable items in response to data transmitted from said stock supervision device to said host computer.

* * * * *

UNITED STATES PATENT AND TRADEMARK OFFICE

CERTIFICATE OF CORRECTION

PATENT NO. : 5,594,529 
DATED : January 14, 1997
INVENTOR(S) : Yuji Yamashita, Jiro Nagira, Yasuhiro Hashimoto and Fumio Aizawa It is certified that error appears in the above-identified patent and that said Letters Patent is hereby corrected as shown below:

Title page,
Item [73], Assignee, delete "Exedy Corporation, Osaka, Japan" substitute
-- Mita Industrial Co. LTD., Osaka, Japan --

Signed and Sealed this

Eighth Day of October, 2002

*Attest:*

*Attesting Officer*

JAMES E. ROGAN
*Director of the United States Patent and Trademark Office*